US008387577B2

(12) United States Patent
Shiino et al.

(10) Patent No.: US 8,387,577 B2
(45) Date of Patent: Mar. 5, 2013

(54) PHASE CHANGING DEVICE FOR AUTOMOBILE ENGINE

(75) Inventors: Minoru Shiino, Hadano (JP); Masaaki Niiro, Hadano (JP); Koichi Homma, Hadano (JP); Michihiro Kameda, Hadano (JP); Masayasu Nagado, Hadano (JP)

(73) Assignee: Nittan Valve Co., Ltd., Hadano-shi (JP)

( * ) Notice: Subject to any disclaimer, the term of this patent is extended or adjusted under 35 U.S.C. 154(b) by 340 days.

(21) Appl. No.: 12/920,530

(22) PCT Filed: Feb. 24, 2009

(86) PCT No.: PCT/JP2009/053242

§ 371 (c)(1),
(2), (4) Date: Sep. 1, 2010

(87) PCT Pub. No.: WO2009/110349

PCT Pub. Date: Sep. 11, 2009

(65) Prior Publication Data

US 2011/0000450 A1 Jan. 6, 2011

(30) Foreign Application Priority Data

Mar. 3, 2008 (JP) ..... 2008-052657

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,684,837 | B2 * | 2/2004 | Miyakoshi | 123/90.17 |
| 2005/0132988 | A1 | 6/2005 | Yamanaka | |
| 2007/0074693 | A1 | 4/2007 | Yamanaka | |

FOREIGN PATENT DOCUMENTS

| | | | |
|---|---|---|---|
| DE | 10 2004 060837 | A1 | 7/2005 |
| JP | 2001-041013 | A | 2/2001 |
| JP | 2005-180307 | A | 7/2005 |
| JP | 3943892 | B2 | 7/2007 |

OTHER PUBLICATIONS

International Search Report of PCT/JP2009/053242, Mailing Date of Jun. 9, 2009.

* cited by examiner

*Primary Examiner* — Zelalem Eshete
(74) *Attorney, Agent, or Firm* — Westerman, Hattori, Daniels & Adrian, LLP

(57) ABSTRACT

A phase changing device for automobile engine, the device comprising curved first guide grooves formed in the control rotor, each groove skewed with respect to a circumference of a circle centered at the rotational axis; oblique guide grooves each groove formed in the middle rotor and extending at an angle with respect to a radius crossing the groove; second guide grooves formed in the drive rotor and skewed with respect to the circumference of a circle centered at the rotational axis, block sections each extending along, and movable in, the respective first guide; first slide members each protruding from the respective block section for engagement with, and for movement in, the respective skewed guide groove; and phase varying members each having a second slide member that extends through an escape groove formed in the middle rotor and engages the respective second guide groove to move in the second guide groove.

2 Claims, 24 Drawing Sheets

(b)

(a)

The arrangement of guide grooves to perform phase angle variation in angle retardation mode

SECTION B-B

SECTION C-C

SECTION D-D

SECTION E-E

SECTION F-F

PHASE CHANGING DEVICE FOR AUTOMOBILE ENGINE

TECHNICAL FIELD

The present invention is directed to a phase changing device for adjusting opening-closing timing of valves of an automobile engine by a torque means of providing the rotary drum of the engine with a torque to adjust the rotational phase of the camshaft relative to a sprocket of the engine.

BACKGROUND ART

A valve timing control device as disclosed in Patent Document 1 cited below has been known in the field. In the device of Patent Document 1, a drive plate 3 driven by the crankshaft of the engine is assembled such that the drive plate 3 is rotatable relative to a flange ring 7 coupled to the camshaft 1 of the device. Integrally mounted to the camshaft 1, to the front side of the drive plate 3, are a lever shaft 10 having three levers 9 and a hold ring 12, which are securely fixed to the flange ring 7 with a bolt 13. A middle rotor 23 is rotatably mounted on the hold ring 12 via a thrust bearing 28 to the front side of the lever shaft 10.

A link 14 is rotatably connected at one end of each of the three levers 9 with a pin 15. Formed at the other end of the link is an axial receptacle hole 16 for receiving therein movable members 17. A radial slot 8 (serving as a radial guide) is formed in the front end of the drive plate 3. Three spiral slots 24, each spiraling in the direction of rotation of the drive plate 3 with decreasing radius, are formed on the rear end of the middle rotor. The movable members 17 are provided at three positions in association with the three corresponding spiral slots 24. Each of the movable members 17 has retainers 19 and 21 for rotatably holding balls 18 and 20 in the respective radial slot 8 and spiral slot 24 via a leaf spring 22.

Provided on the front end of the middle rotor 23 is a permanent magnet block 29 having N- and S-poles that alternates along the circumference of the rotor 23. Arranged in front of the permanent magnet block 29 is a yoke block 30 having a first pole tooth ring 37 and a second pole tooth ring 38 for generating different magnetic poles when electromagnetic coils 33A and 33B are energized. The magnetic poles of the pole tooth rings 37 and 38 are switched on and off in a given switching pattern by the middle rotor 23 so as to apply changing magnetic forces on the permanent magnet block 29 to rotate the drive plate 3 relative to the camshaft 1. The rotation of the drive plate 3 is terminated by ending switching of the polarities.

As the middle rotor 23 is angularly advanced in relative to the drive plate 3 in the rotational direction R (referred to as angularly advancing direction) under the polarity switching of the polar tooth rings 37 and 38, the balls 18 and 20 of the movable member 17 are displaced radially outward in the respective radial slot 8 and spiral slot 24. Then, the lever shaft 10 is retarded in relative to the drive plate 3. That is, the level shaft 10 rotates in the angularly retarding direction (opposite to the rotational direction R of the drive plate 3), thereby rendering the rotational phase of the crankshaft and camshaft 1 retarded in the angularly retarding direction. On the other hand, when the polarity switching pattern of the polar tooth rings 37 and 38 is changed so as to delay the middle rotor 23 in the angularly retarding direction, the movable member 17 is displaced radially inward, thereby rendering the rotational phase of the crankshaft and camshaft changed in the angularly advancing direction.

During an operation, the camshaft 1 is subjected to reactions of the valve springs, which cause disturbing torques on the camshaft. Such disturbing torques may cause unexpected angular displacements of the drive plate 3 relative to the camshaft 1. The device of Patent Document 1 has a self-lock mechanism in which the camshaft 1 is immovably locked to the drive plate 3 via the link 14 and the lever 9 by pushing the ball 20 in the direction perpendicular to the spiral slot 24 against the inner wall of the spiral slot 24 when a disturbing torque occurring in the camshaft 1 is transferred to the movable member 17 via the lever 9 and the link 14, causing the ball 18 to be displaced in the radial slot 8 in the direction perpendicular to the spiral slot 24.

DISCLOSURE OF THE INVENTION

Objects of the Invention

The prior art device has an unresolved problem that, in the event of a torque disturbance as mentioned above, the balls 20 collide the inner wall of the spiral slot 24 located on either the outward or the inward side of the radial groove 8, when each ball makes point contact with the wall and applies a large pressure on a small local area of the spiral slot 24. This is a source of frictional wear to the spiral slot and causes eventual backlashes in the ball-groove system.

Another problem is that under the disturbing torque the balls 18 and 20 can generate axial thrusts in the camshaft 1 via the retainers 19 and 21, radial slot 8, and spiral slot 24, which may cause an axial backlash of the link 14.

Yet still another problem is that it is difficult to provide a large phase angle variation between the camshaft 1 and the drive plate 3 in the structurally complex link mechanism 14 of the prior art device.

The present invention overcomes the problems in the prior art as mentioned above by providing a phase changing device for use with an automobile engine. The device has a self-lock mechanism in which phase varying members play roles of the prior art balls 18 and 20 without generating local pressure on one side of the inner circumferential walls of the groove guides as they are displaced in the groove guides, thereby preventing frictional wear of the inner circumferential walls of the groove guides and avoiding generation of such axial thrusts as mentioned above. In this device a large phase angle variation between the camshaft 1 and the drive plate 3 can be achieved.

Means for Solving the Problems

To achieve these objects, a first embodiment of the present invention provides a phase changing device, comprising: a drive rotor driven by a crankshaft of an engine, a middle rotor integral with the camshaft of the device and arranged ahead of the drive rotor, a control rotor arranged ahead of the middle rotor and rotatable about a rotational axis common to the drive rotor and the middle rotor, the device capable of altering a relative phase angle between the drive rotor and the camshaft by rotating the middle rotor relative to the drive rotor by providing the control rotor with a torque generated by a torque means, the device further comprises:

curved first guide grooves formed in the control rotor, each groove skewed with respect to a circumference of a circle centered at the rotational axis;

oblique guide grooves, each groove formed in the middle rotor and extending at an angle with respect to a radius crossing the groove;

second guide grooves formed in the drive rotor and skewed with respect to the circumference of a circle centered at the rotational axis of the drive rotor;

block sections, each extending along, and movable in, the respective first guide;

first slide members, each protruding from the respective block section for engagement with, and movement in, the respective skewed guide groove; and phase varying members, each having a second slide member that extends through an escape groove formed in the middle rotor and engages the respective second guide groove so as to move in the second guide groove.

When subjected to a brake action of the torque means, the control rotor is retarded in a phase angle relative to the middle rotor. The phase varying members move radially on the control rotor as the block sections are displaced in the curved first guide grooves skewed with respect to the circumference. As the first slide members of the phase varying members are displaced in the respective oblique guide grooves and the second slide members are displaced radially in the respective second guide grooves, the middle rotor integrated to the camshaft rotates relative to the drive rotor in a manner defined by the configuration of the second guide grooves, thereby adjusting the phase angle between the camshaft and the drive rotor driven by the crankshaft.

The inventive device as described above is provided with a self-lock mechanism adapted to immovably lock the phase varying members, should torque disturbance occur in the camshaft movement caused by reaction of the valve springs, thereby prohibiting the relative rotational motion of the middle rotor and the drive rotor to prevent unexpected phase variation between the camshaft and the drive rotor driven by the crankshaft.

(Function)

In other words, if such torque disturbance takes place, the middle rotor coupled to the camshaft is subject to a torque that causes the middle rotor to rotate relative to the drive rotor. In that event, the first slide members are subject to force transferred from the engaging oblique guide grooves in radially inward directions, and the second slide members are subject to force transferred from the second guide grooves in the substantially opposite directions. The block sections of the phase varying members are subject to radial force from the first and second slide members in the radially opposite directions. These forces skew the phase varying members in the engagement of the first guide grooves, and force them against the opposite inner walls of the first guide grooves, resulting in frictional force acting on the block sections from the opposite sides, and immovably fixing the phase varying members in position in the first guide grooves.

In this case, the first and second slide members protruding from the block sections are also immovably fixed relative to the engaging oblique guide grooves and the second guide grooves. Thus, the middle rotor coupled to the camshaft is immovably fixed relative to the drive rotor, thereby preventing unanticipated phase variation that could otherwise occur between the camshaft and the drive rotor driven by the crankshaft.

That IS, should such torque disturbance take place, the phase varying members generate frictional forces via the block sections, which act on the both sides of the first guide grooves, so that frictional forces are not localized but are distributed over different areas of the grooves.

Further, since the block sections are not spherical in shape, the block sections will not generate forces in response to the torque disturbance that thrust the respective rotors in the axial direction.

A second embodiment of the inventive device provides the first and the second slide members in the form of a shaft-like member that can roll in the respective first and the second guide grooves.

(Function)

By providing the first and second slide members in the form of rollable shaft-like members, less frictional force is generated on the wall of the oblique guide grooves and the second guide grooves. In addition, disturbing torque is transferred to the block sections without being damped by the sliding friction of the first and the second slide members.

Results of the Invention

The first embodiment of the invention described above will generate little local friction with the phase varying members in contact with the first guide grooves, thereby reducing the wear of the contact areas thereof and the impact to the members.

Fewer axial thrusts will be generated, hence axial impact to the mechanism is reduced.

It should be noted that the phase variation mechanism can be obtained in a simple combination of phase varying members and guide grooves. In addition, a large phase variation angle can be achieved by providing sufficiently long first guide grooves.

The second embodiment of the invention described above will generate little friction with the first and second slide members in sliding contact with the oblique and the second guide grooves, thereby reducing axial impact on the mechanism. In addition, since disturbing torque is transferred to the block sections without being damped by the sliding frictions of the first and second slide members, the block sections of the first guide grooves can be infallibly locked.

BRIEF DESCRIPTION OF THE DRAWINGS

FIG. 5(*a*) is a perspective view and FIG. 5(*b*) is an exploded perspective view.

FIG. 11(*a*)-(*c*) its shows the phase varying members subject to force generated in cam torque disturbance.

FIG. 12(*a*) shows the initial arrangement of the guide grooves and the phase varying members of the respective rotors;

FIGS. 12(*b*) and (*c*) shows the phase varying members subject to external force caused by a cam torque disturbance.

FIG. 18(*b*) shows a transverse cross section of the second control rotor taken along Line H-H of FIG. 17;

FIG. 18(*c*) shows a transverse cross section of the second control rotor taken along Line I-I of FIG. 17.

FIG. 19(*a*)-(*c*) respectively show the initial condition prior to a phase variation, and a condition after a maximum phase variation.

FIG. 23(*b*) shows a cross section of a cam guide plate taken along Line K-K of FIG. 22; and FIG. 23(*c*) shows a cross section of a circular eccentric cam of a control rotor, taken along Line L-L of FIG. 22.

FIG. 24(*a*)-(*c*) respectively show conditions of the device prior to a phase variation, during a phase variation; and after a maximum phase variation.

SYMBOLS

Figure 1:
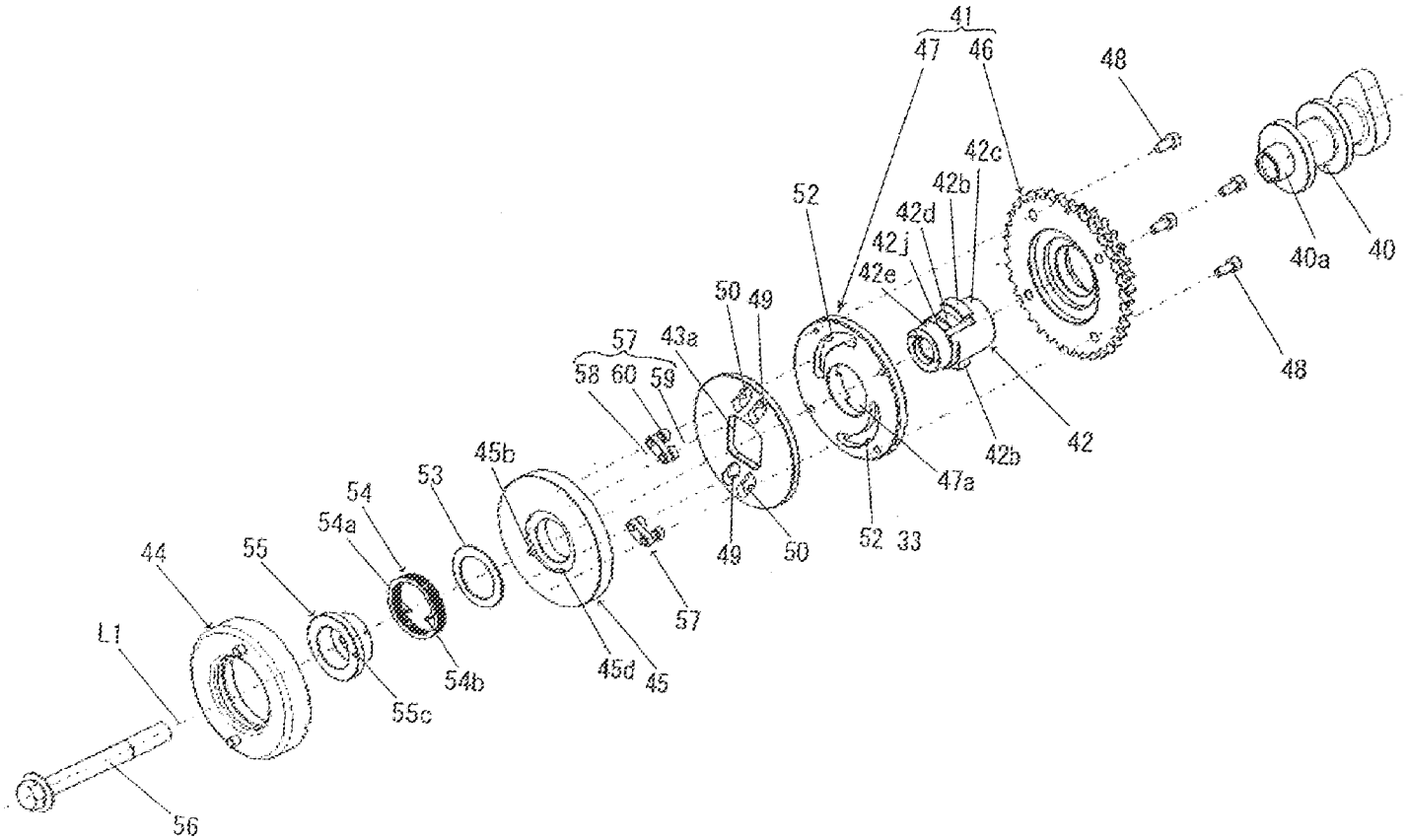
FIG. 1 is an exploded perspective view of a phase changing device for use with an automobile engine in accordance with a first embodiment of the invention, the view taken from front.

40: camshaft
41: drive rotor
43: middle rotor
44: electromagnetic clutch (torque means)
45: control rotor
46: sprocket (drive rotor)
47: drive plate (drive rotor)
49 and 49': oblique guide grooves
50: escape groove
51: first guide groove
52 and 52': second guide grooves
54: torsion spring
57: phase varying members
58: block sections
59: first slide members
60: second slide members
67, 72, and 81: second electromagnetic clutches (torque means)
L1: rotational axis

BEST MODE FOR CARRYING OUT THE INVENTION

The invention will now be described in details by presenting examples with reference to the accompanying drawings.

Figure 2:
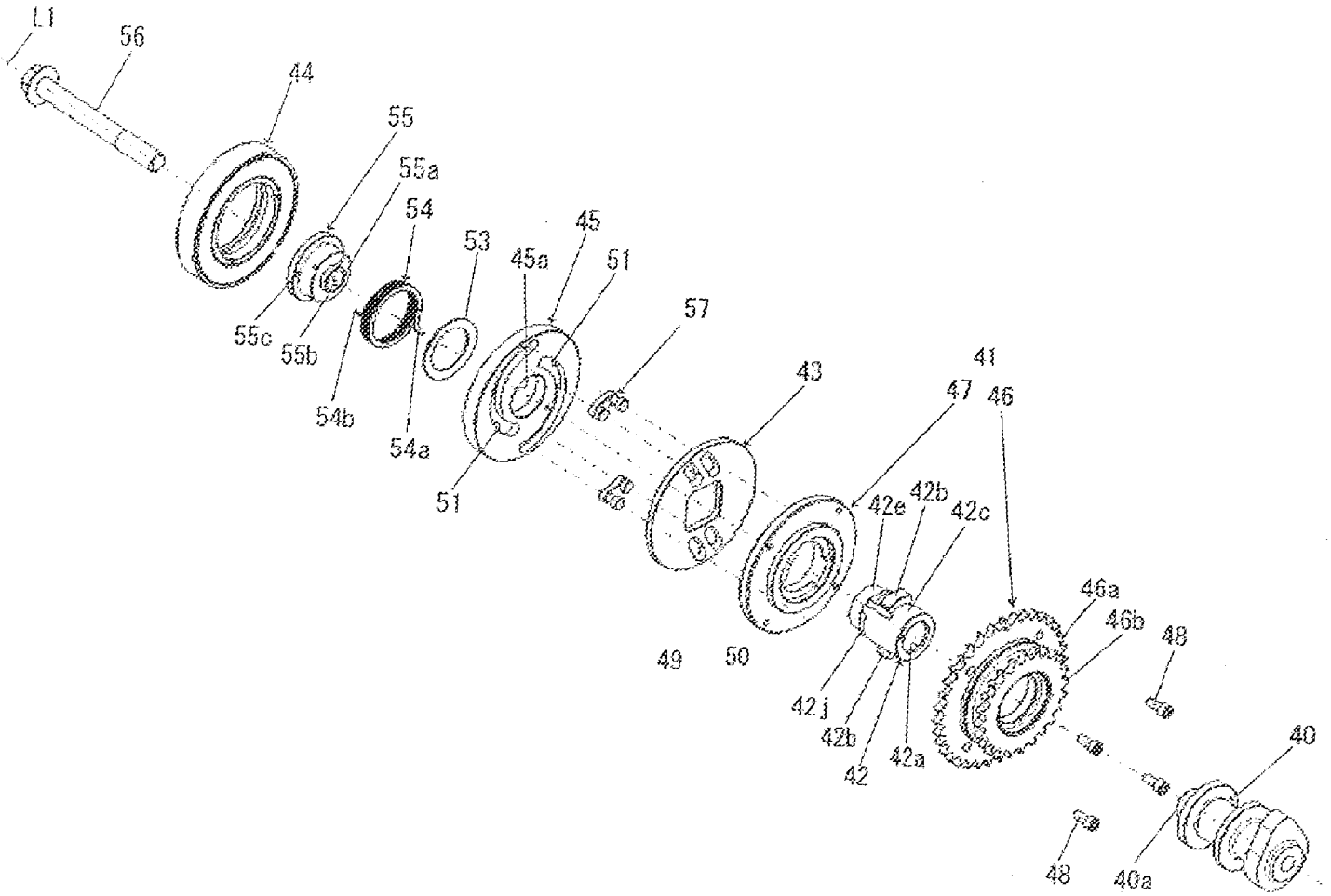
FIG. 2 is an exploded perspective view of the device taken from behind.
Figure 3:
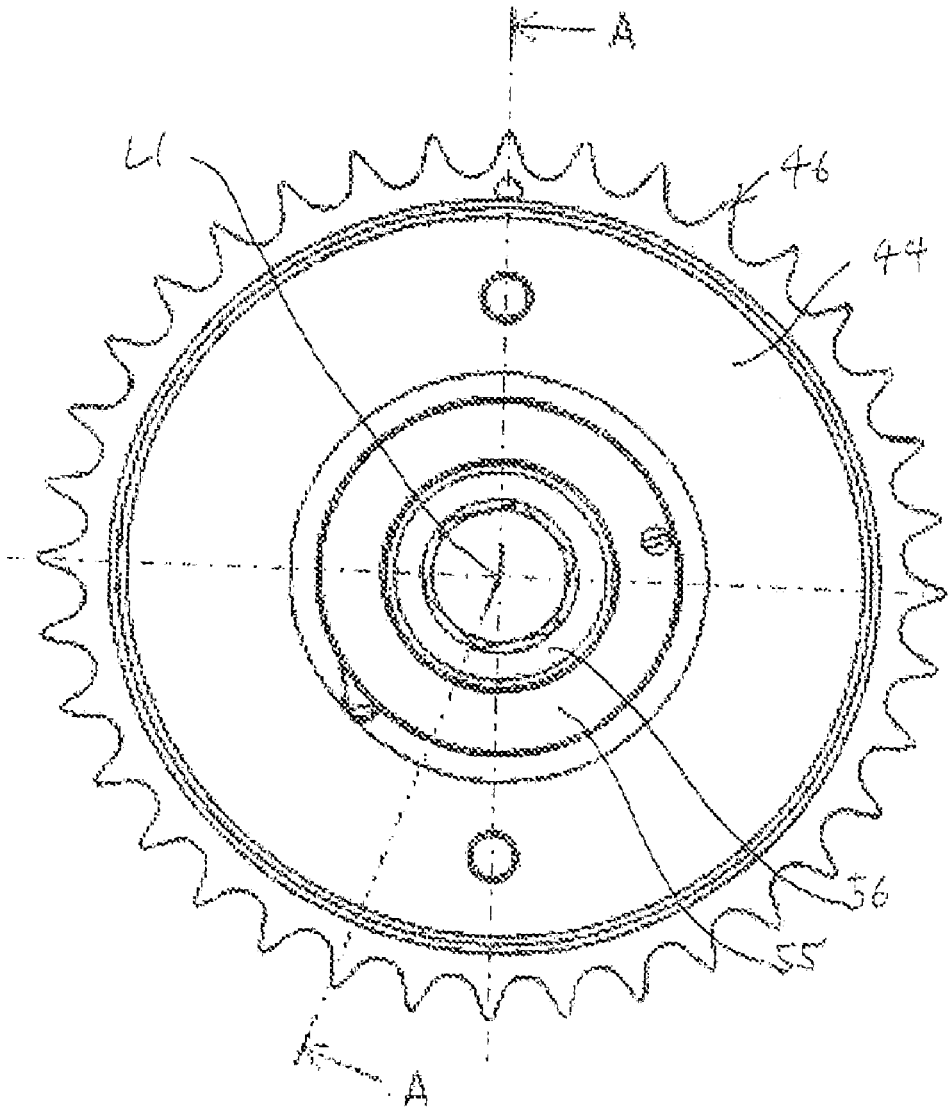
FIG. 3 is a front view of the device.
Figure 4:
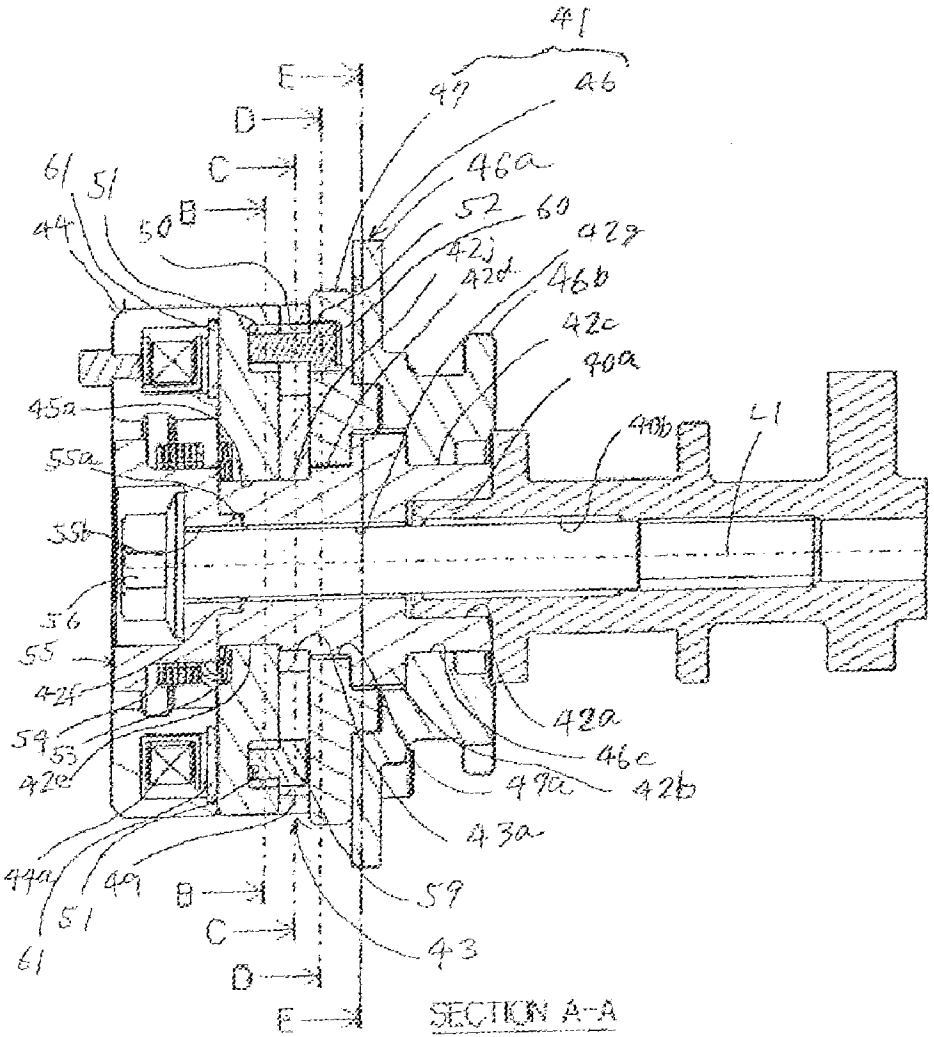
FIG. 4 is an axial cross section of the device taken along Line A-A of FIG. 3.
Figure 5:
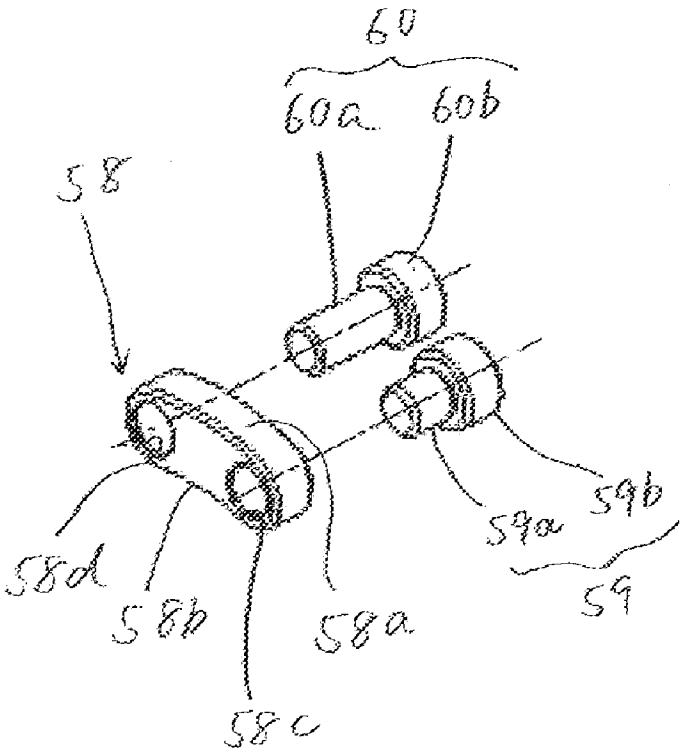
FIG. 5 is a diagram illustrating phase varying members.
Figure 5:
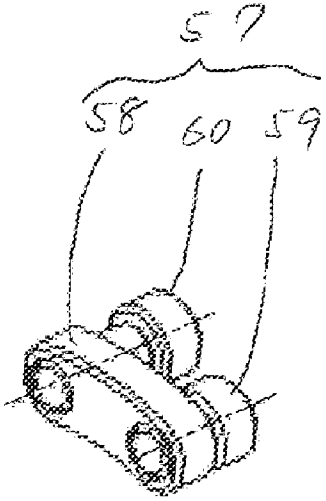
Figure 6:
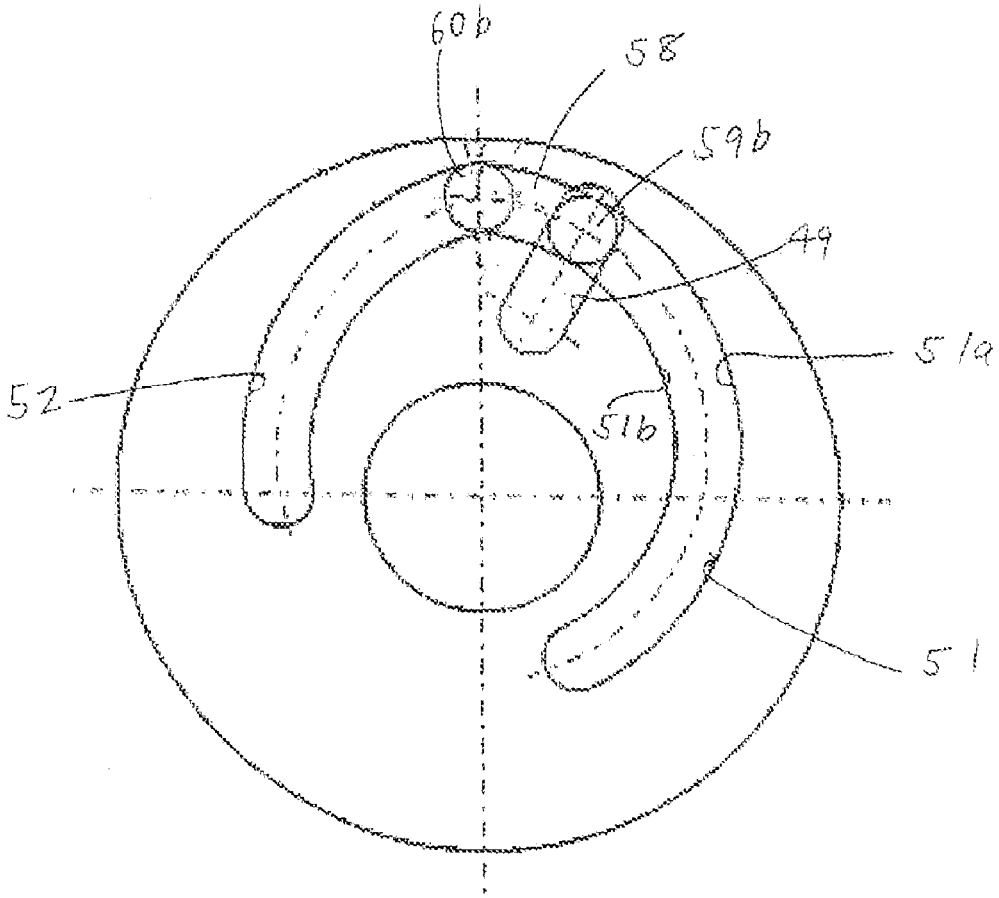
FIG. 6 is a diagram showing the arrangement of guide grooves and phase varying members in accordance the first embodiment in which the device is adapted to perform a phase angle variation in an angle retardation mode.
Figure 7:
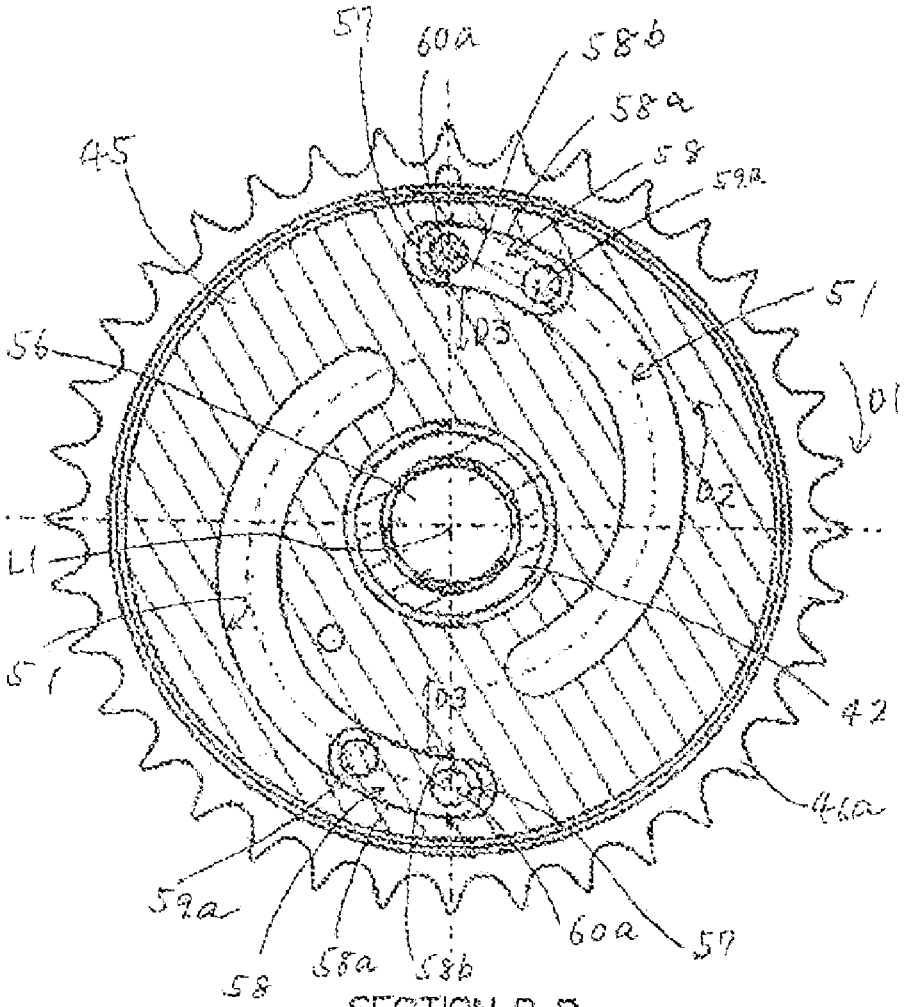
FIG. 7 is a vertical cross section of a control rotor of the device, taken along Line B-B of FIG. 4.
Figure 8:
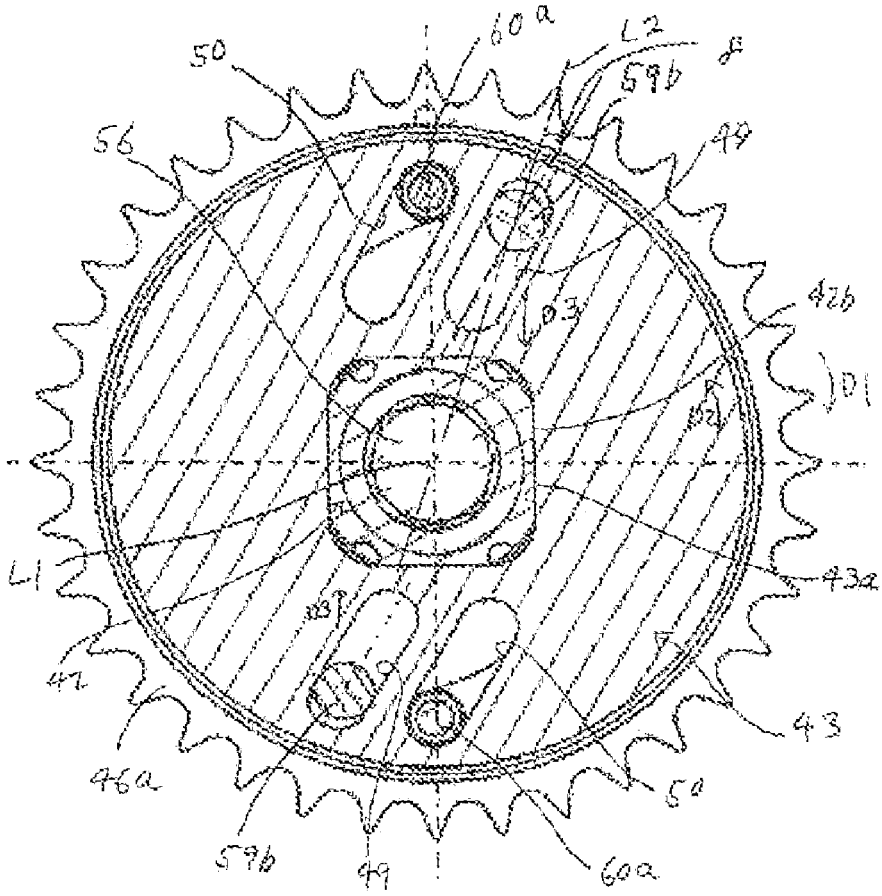
FIG. 8 is a cross section of a middle rotor taken along Line C-C of FIG. 4.
Figure 9:
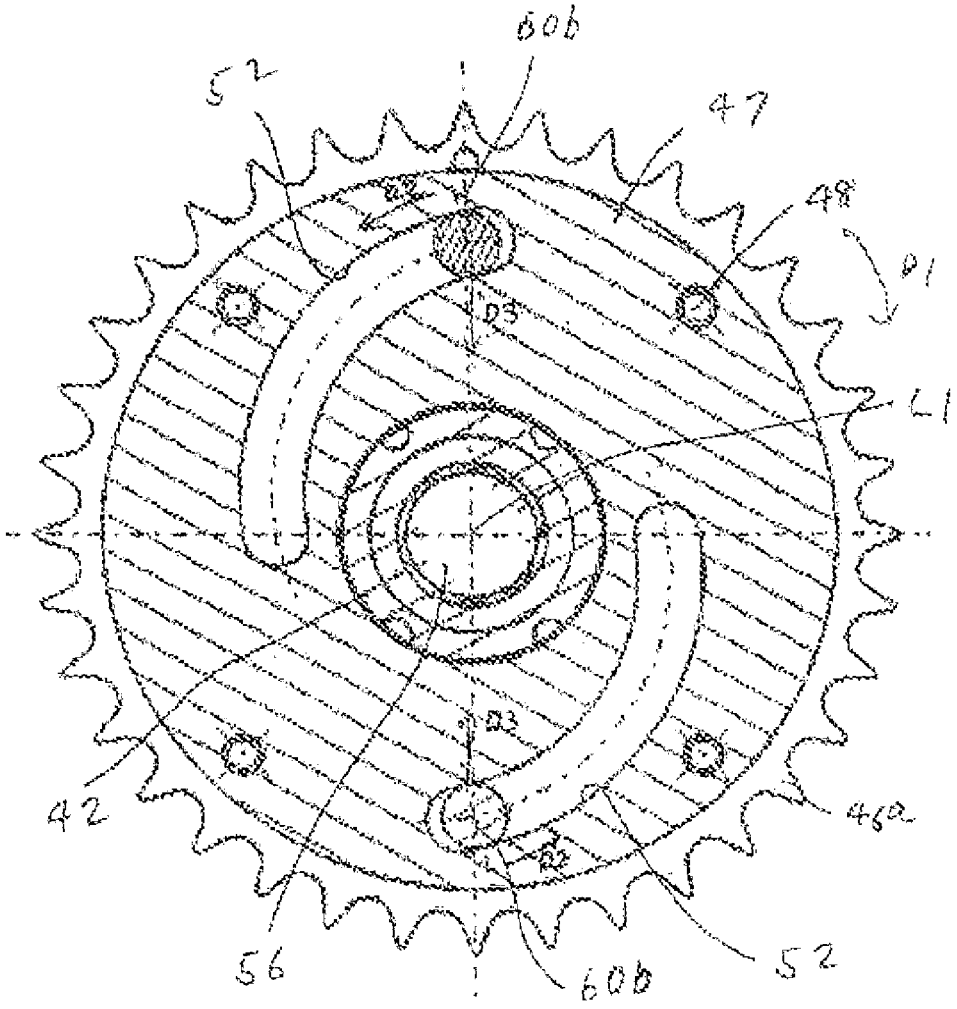
FIG. 9 is a cross section of a drive rotor of the device taken along Line D-D of FIG. 4.
Figure 10:
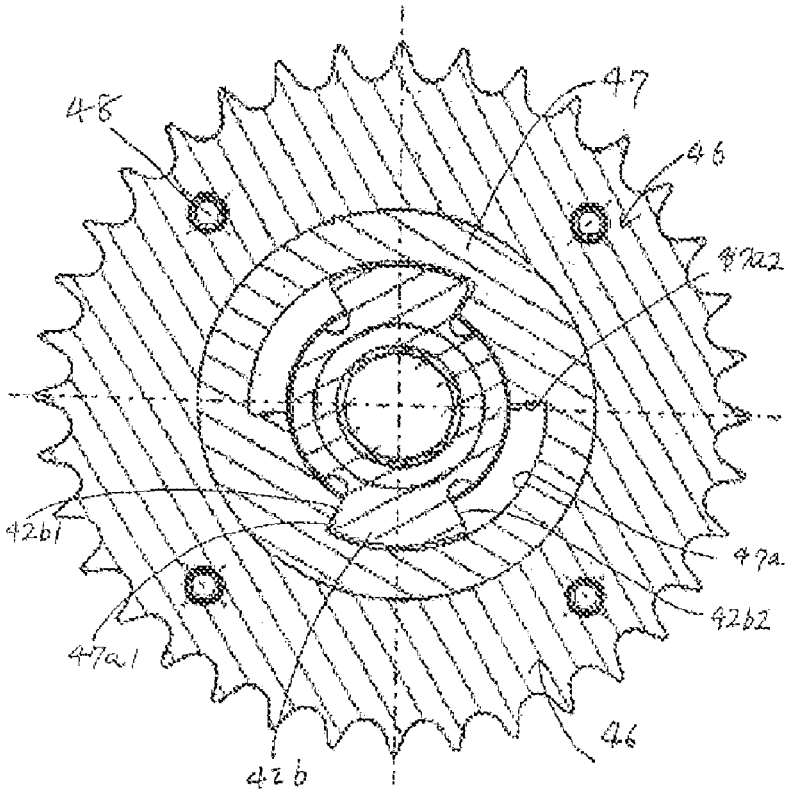
FIG. 10 is a cross section of a phase variation stopper of the device taken along Line E-E of FIG. 4.
Figure 11:
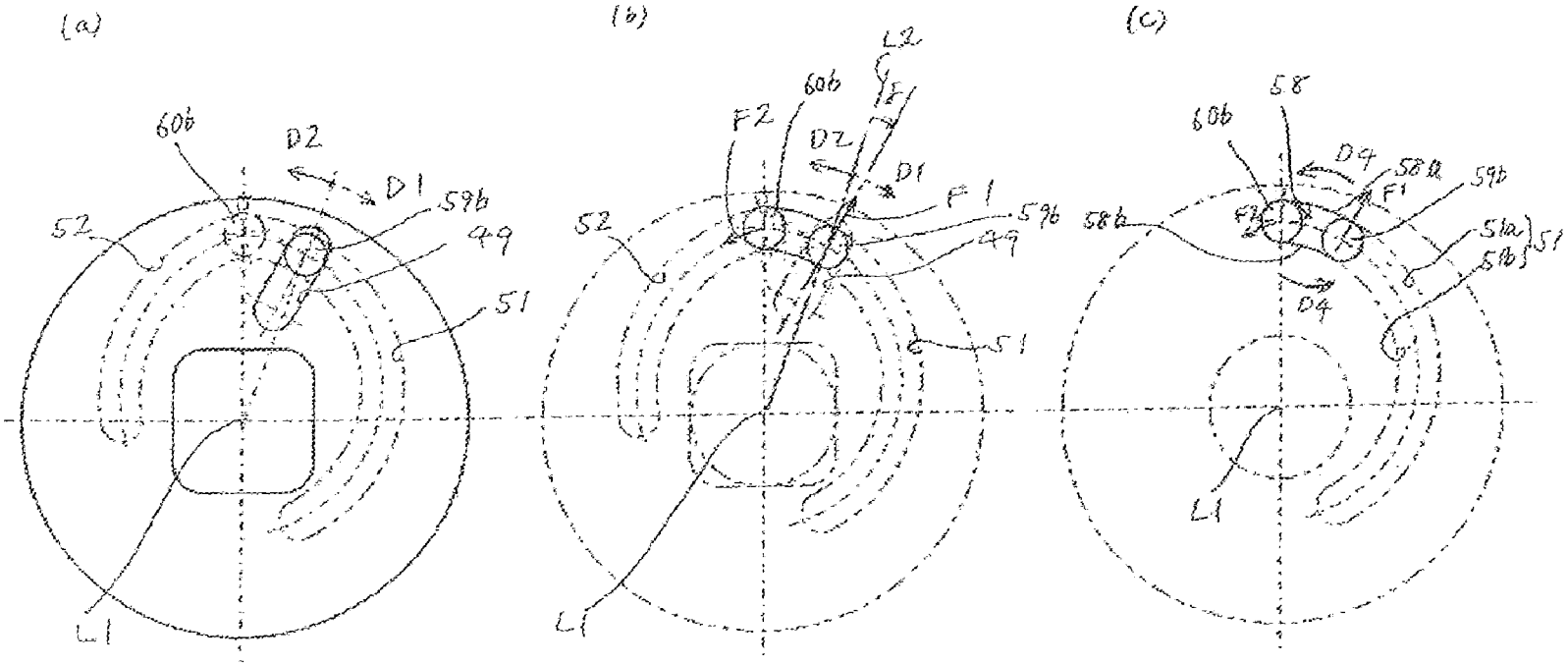
FIG. 11 is a diagram illustrating the self-lock mechanism of the first embodiment.
Figure 12:
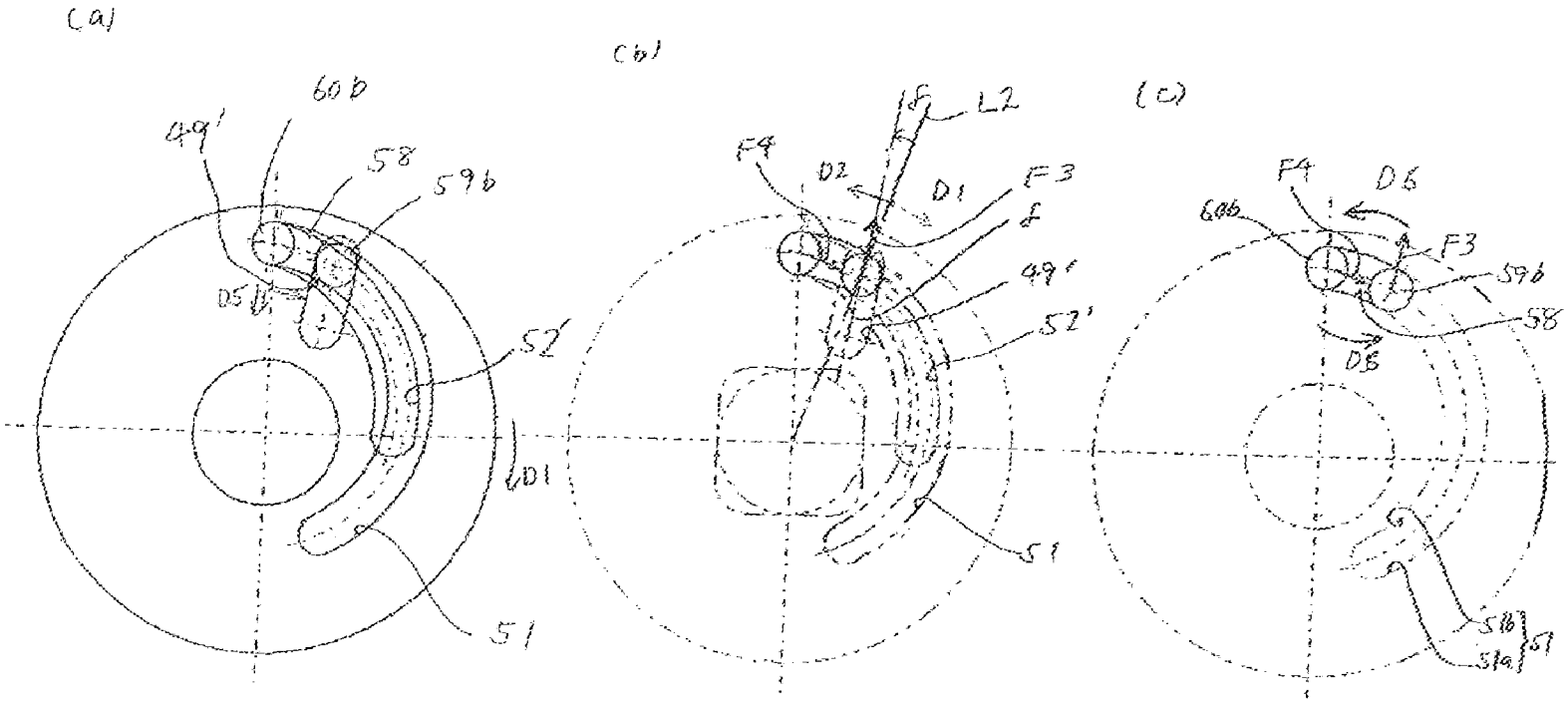
FIG. 12 is a diagram illustrating an arrangement (referred to as phase advancing arrangement) for performing a phase variation in the angularly advancing direction.
Figure 13:
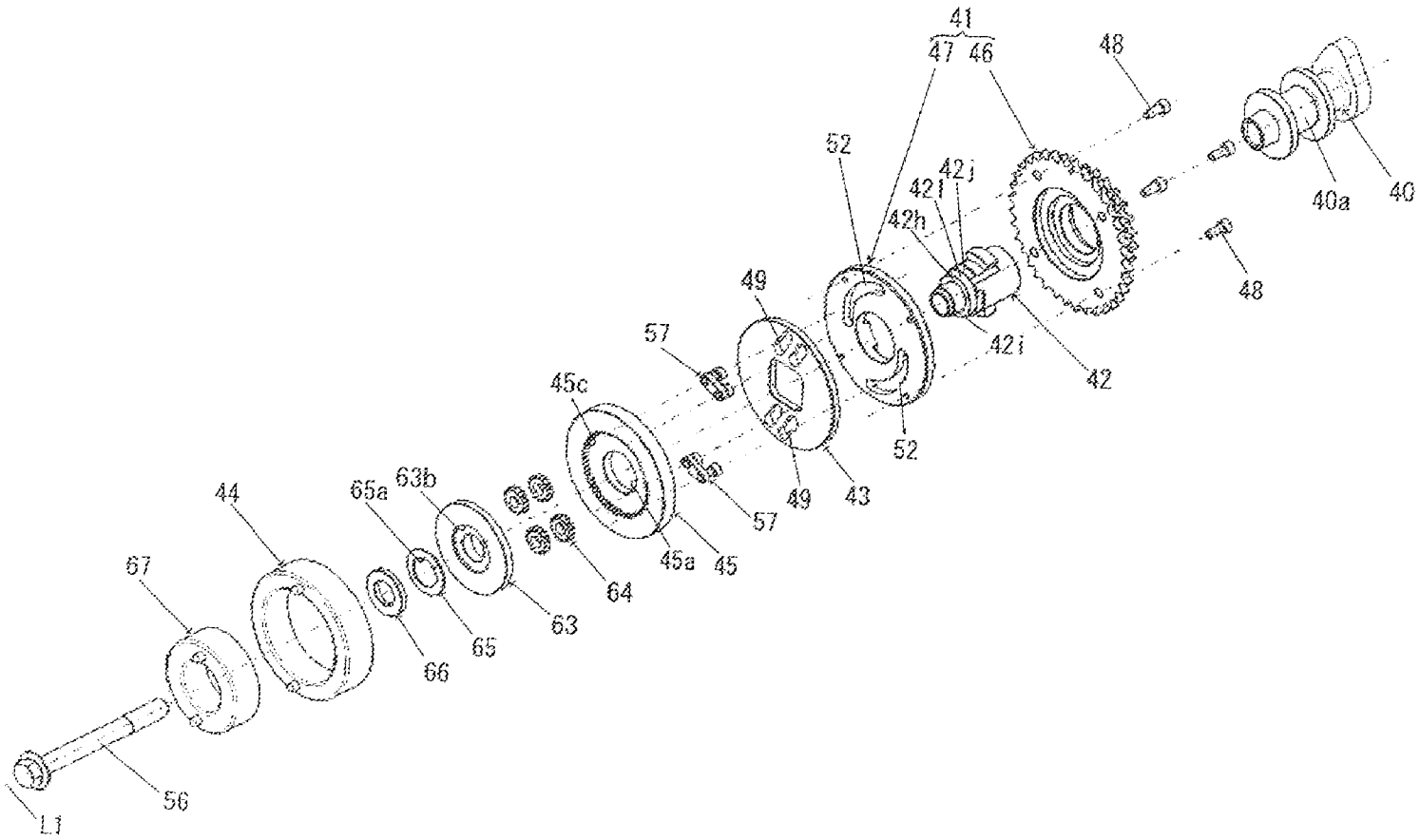
FIG. 13 is an exploded perspective view of the phase changing device in accordance with the second embodiment of the invention for use with an automobile engine.
Figure 14:
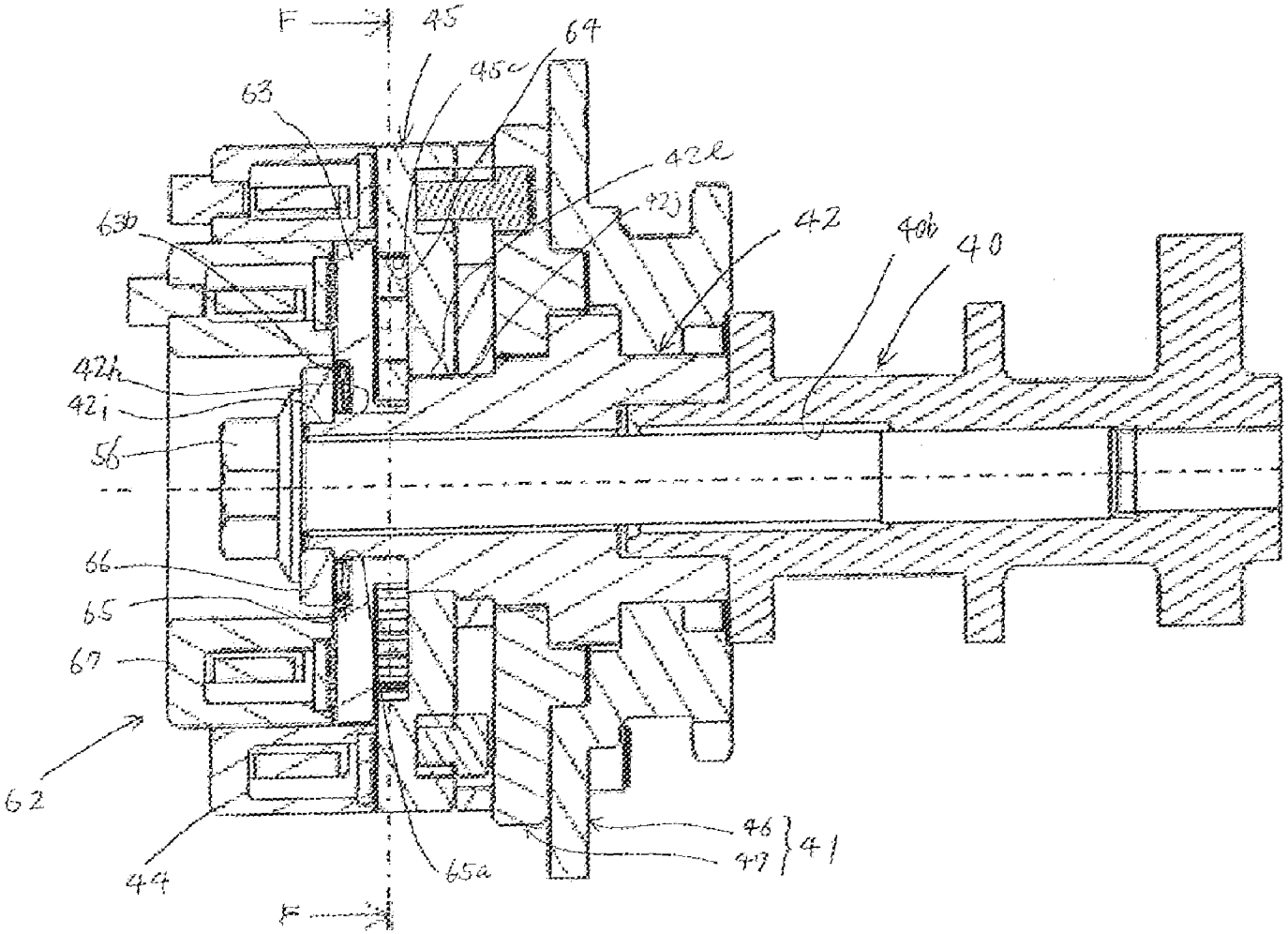
FIG. 14 is an axial cross section of the device of the second embodiment of the invention.
Figure 15:
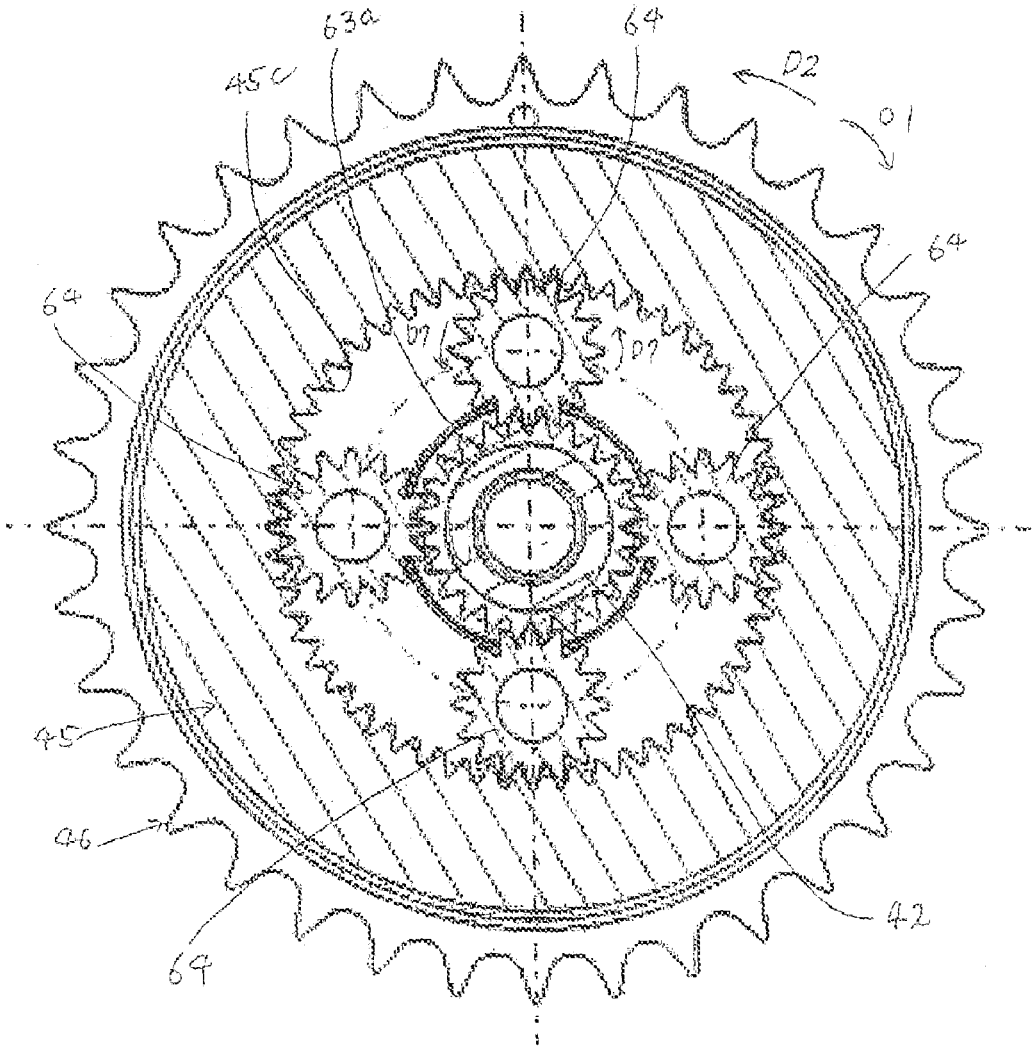
FIG. 15 is a cross section of a mechanism for performing the relative rotation of the control rotor and the second control rotor, taken along Line F-F of FIG. 14.
Figure 16:
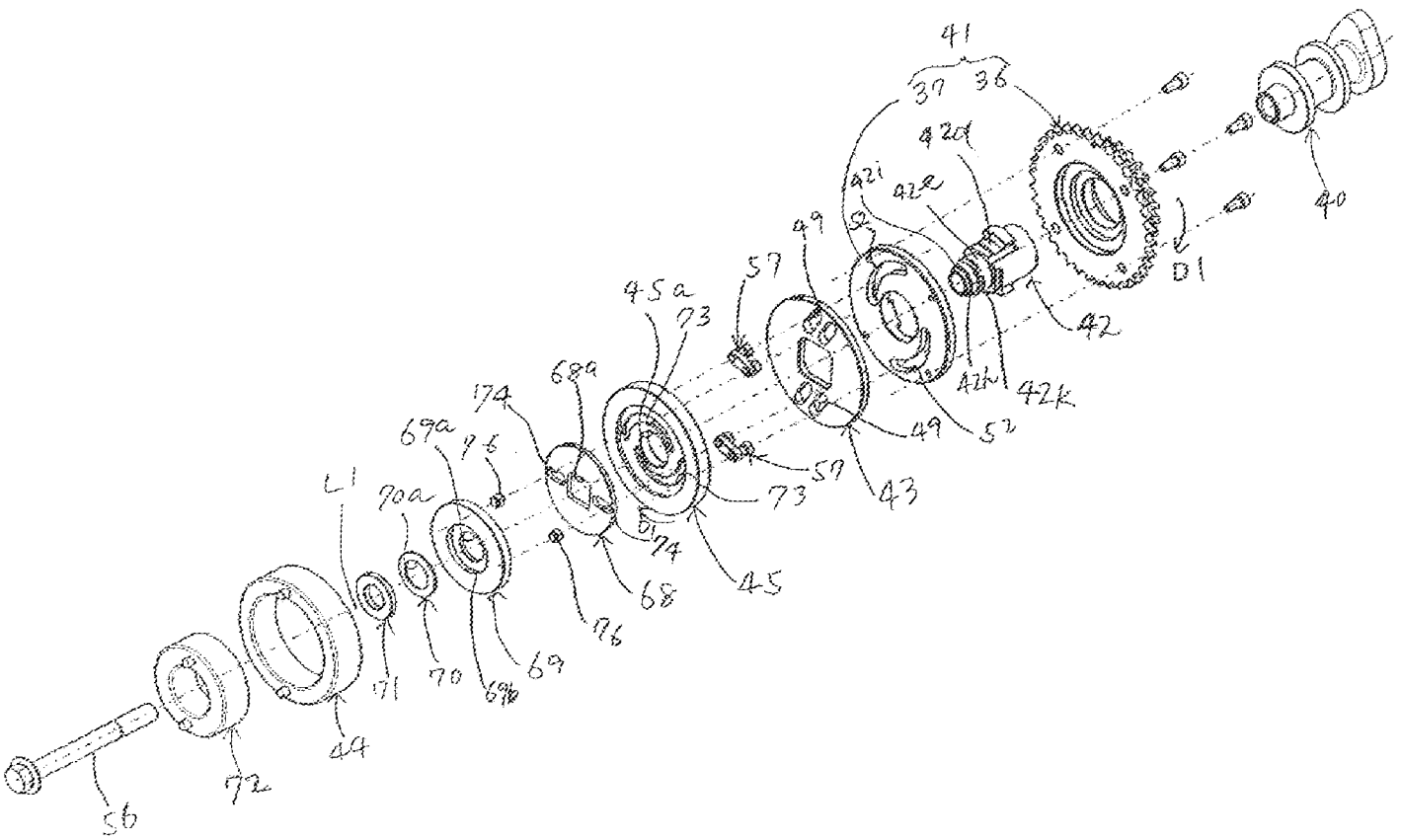
FIG. 16 is an exploded perspective view of the phase changing device for use with an automobile engine in accordance with a third embodiment of the invention, the view taken from front.
Figure 17:
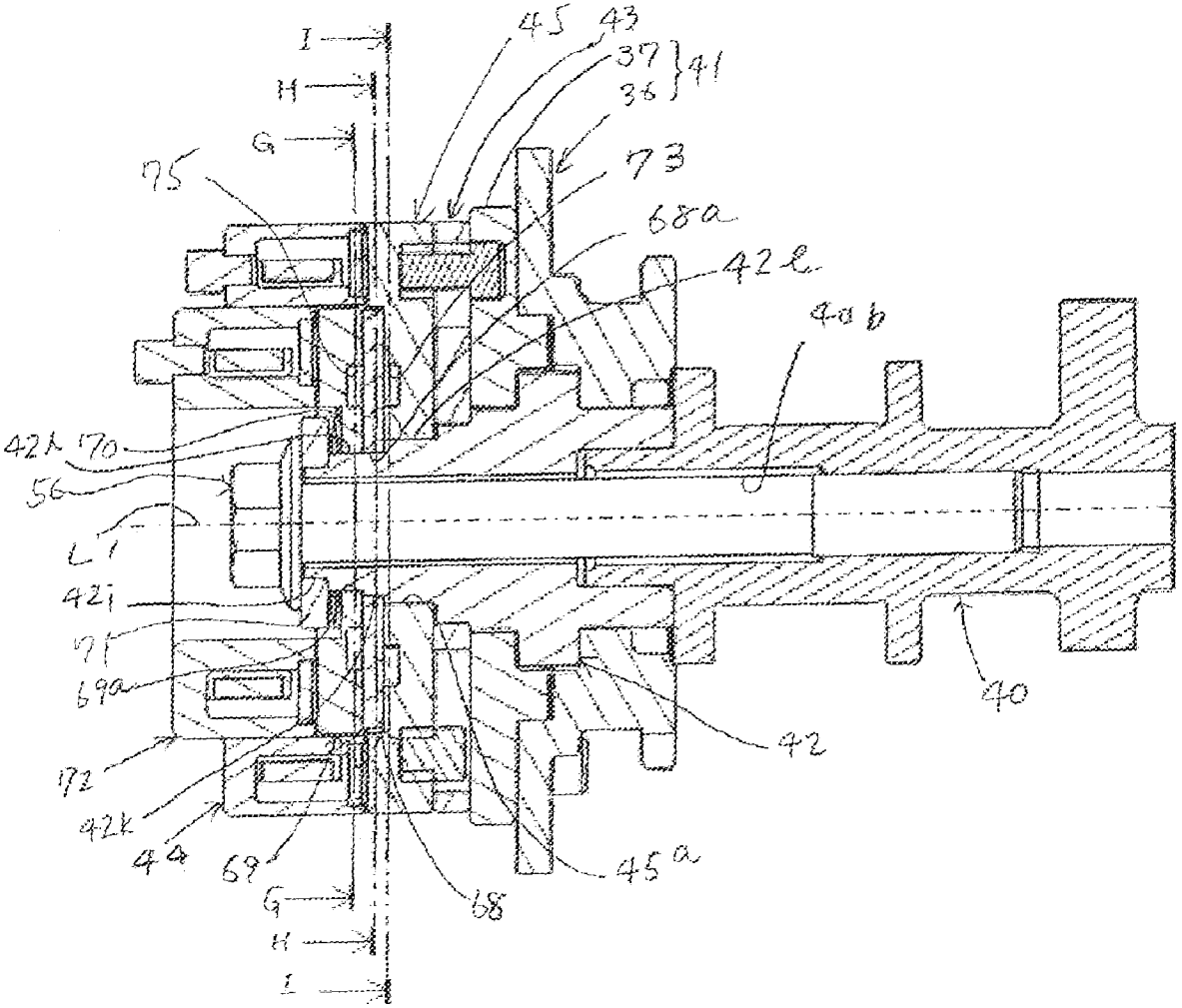
FIG. 17 is an axial cross section of the device in accordance with the third embodiment of the invention.
Figure 18:
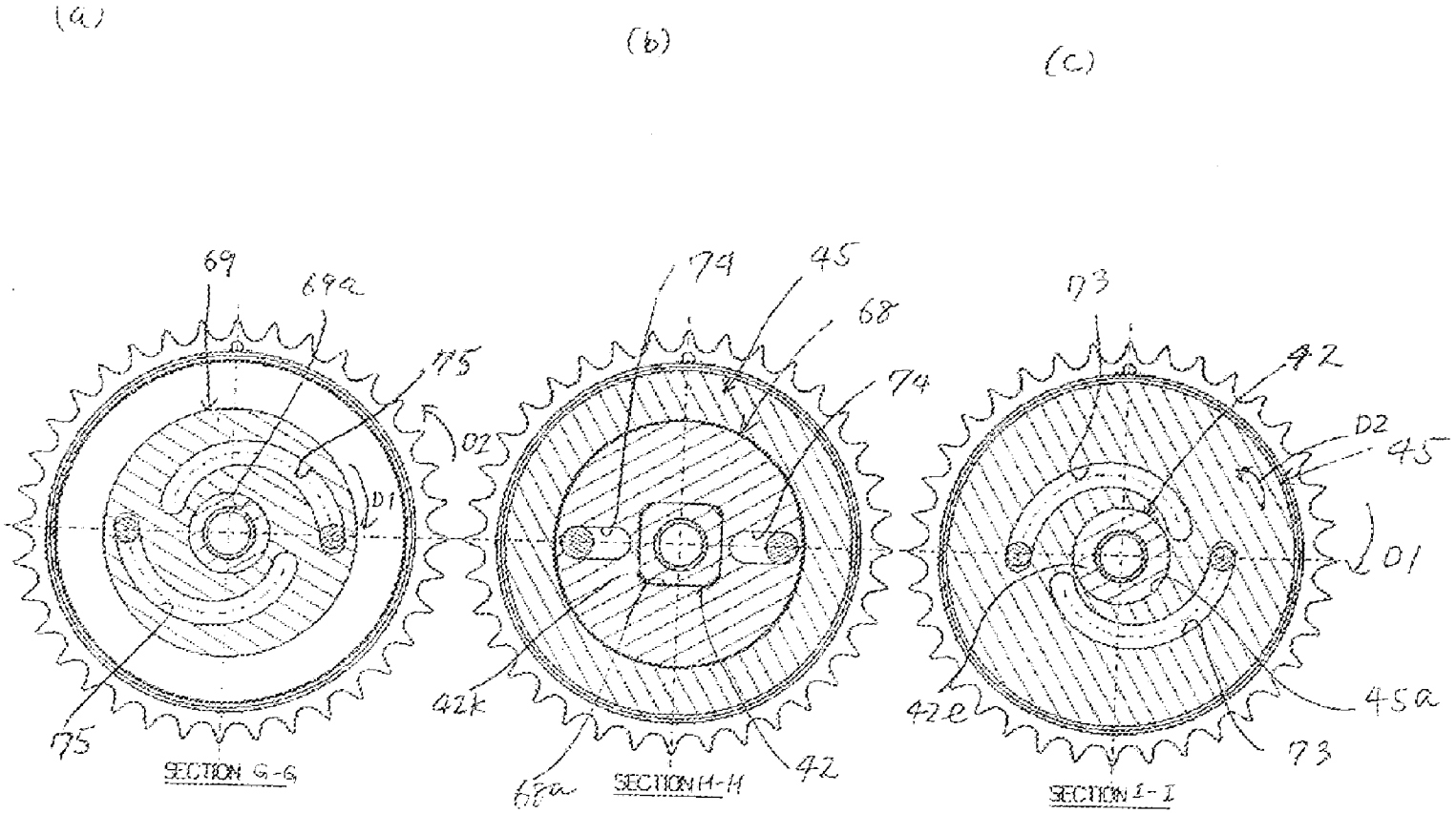
FIG. 18(*a*) shows a transverse cross section of the second control rotor taken along Line G-G of FIG. 17.
Figure 19:
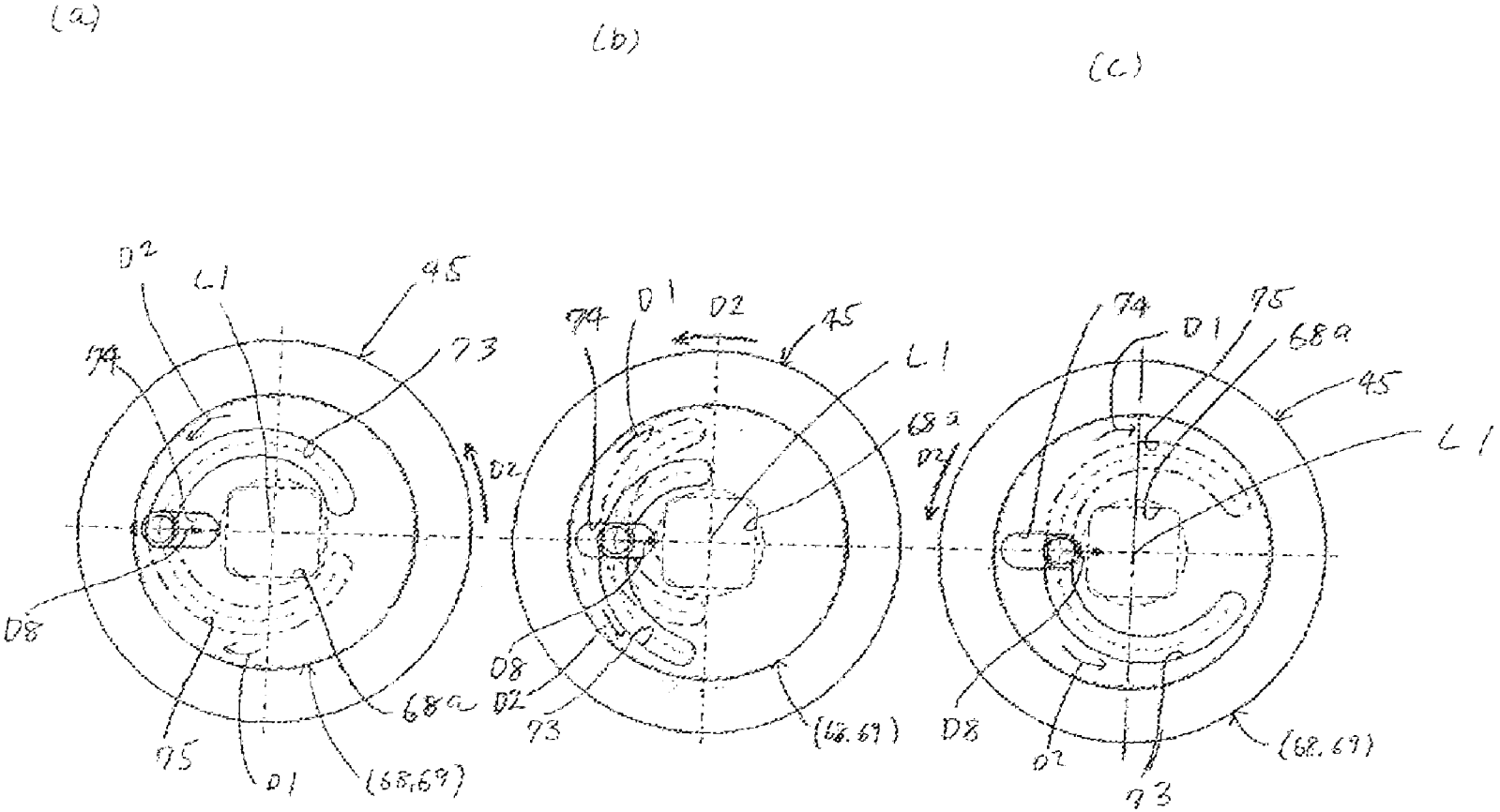
FIG. 19 shows a device of the third embodiment in operation.
Figure 20:
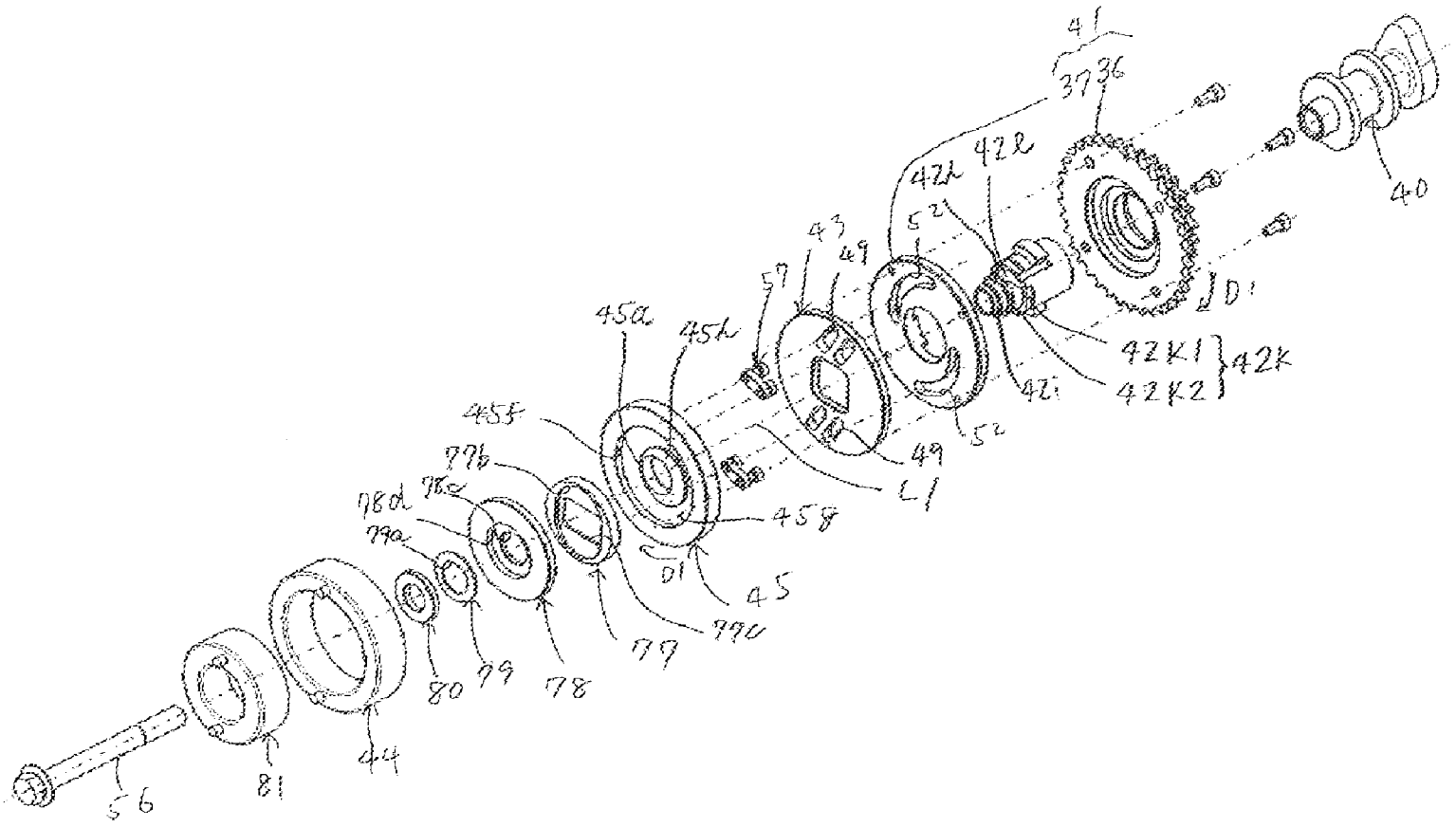
FIG. 20 is an exploded perspective view of a phase changing device for use with an automobile engine in accordance with a fourth embodiment of the invention, the view taken from front.
Figure 21:
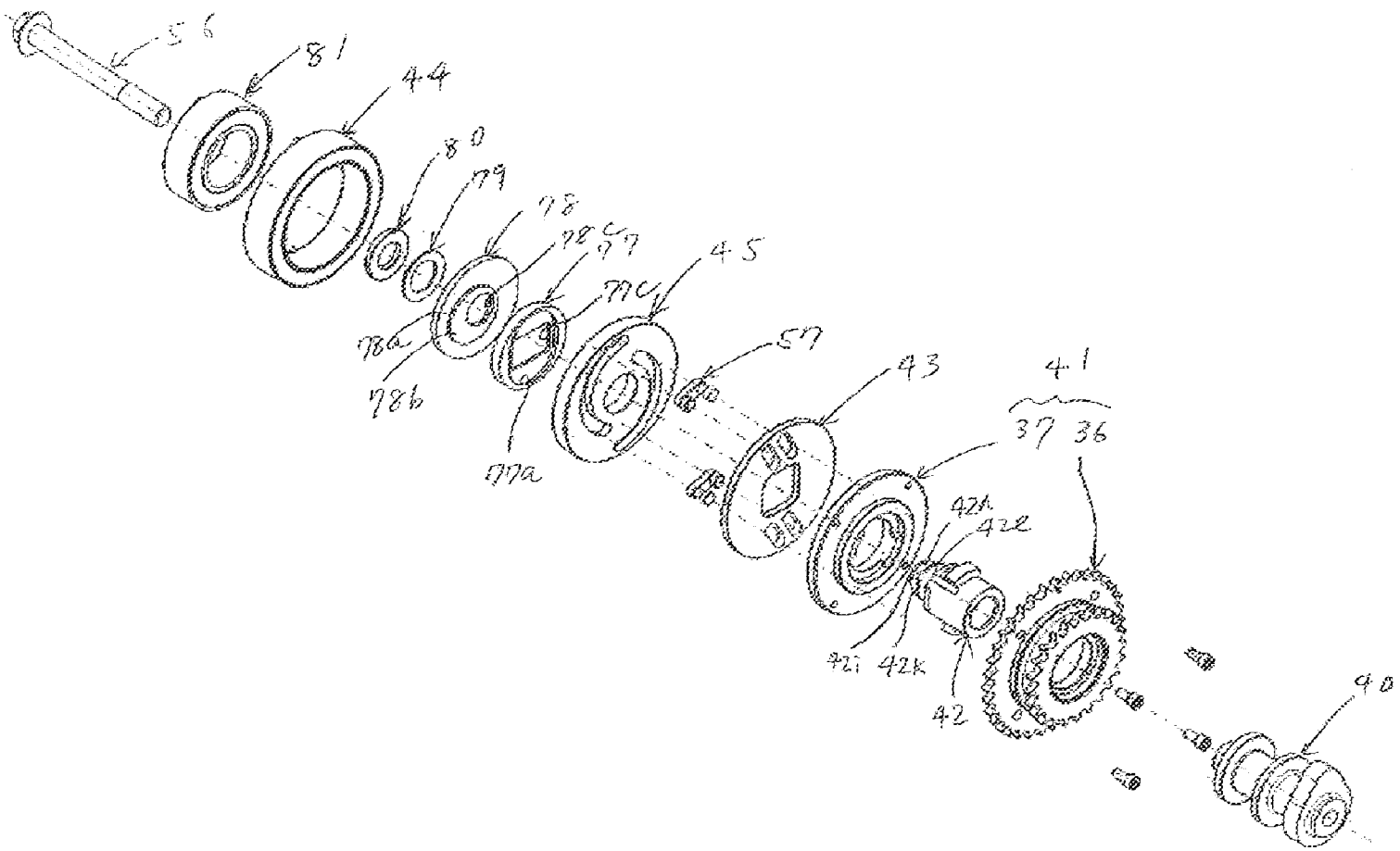
FIG. 21 is an exploded perspective view of the device according to the fourth embodiment of the invention, the view taken from behind.
Figure 22:
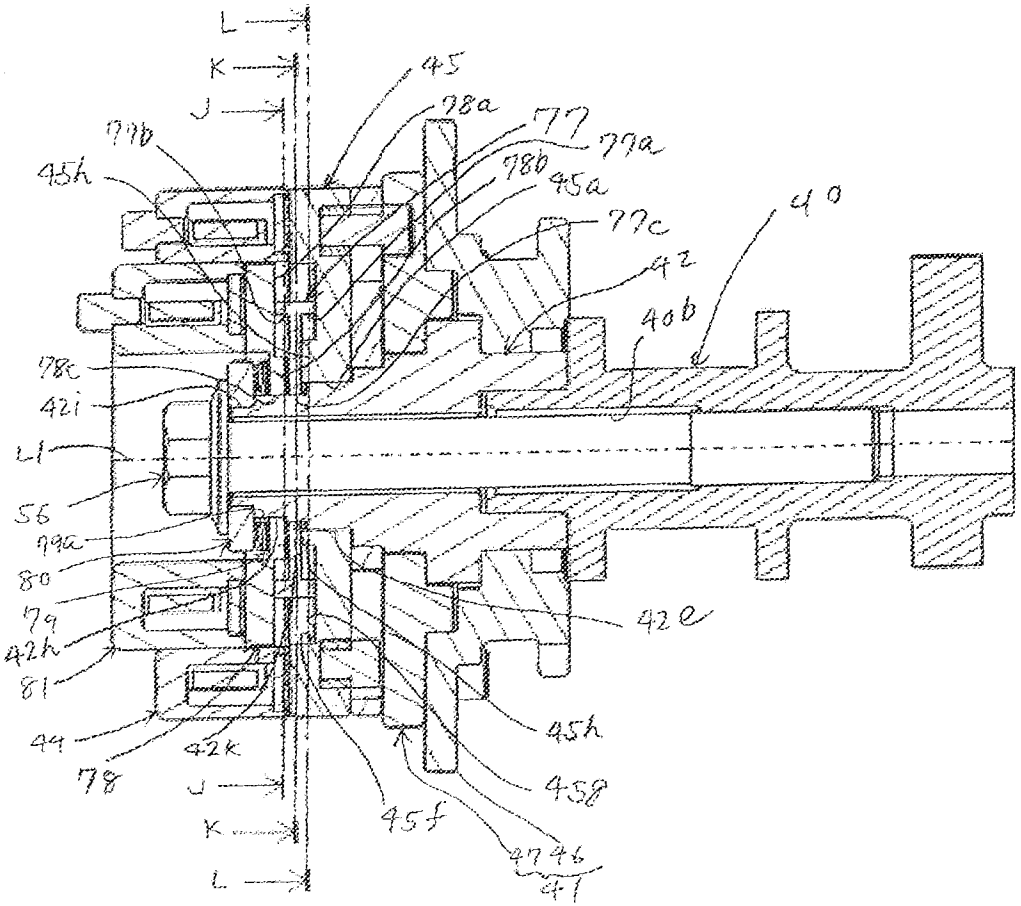
FIG. 22 is an axial cross section of the device in accordance with the fourth embodiment of the invention.
Figure 23:
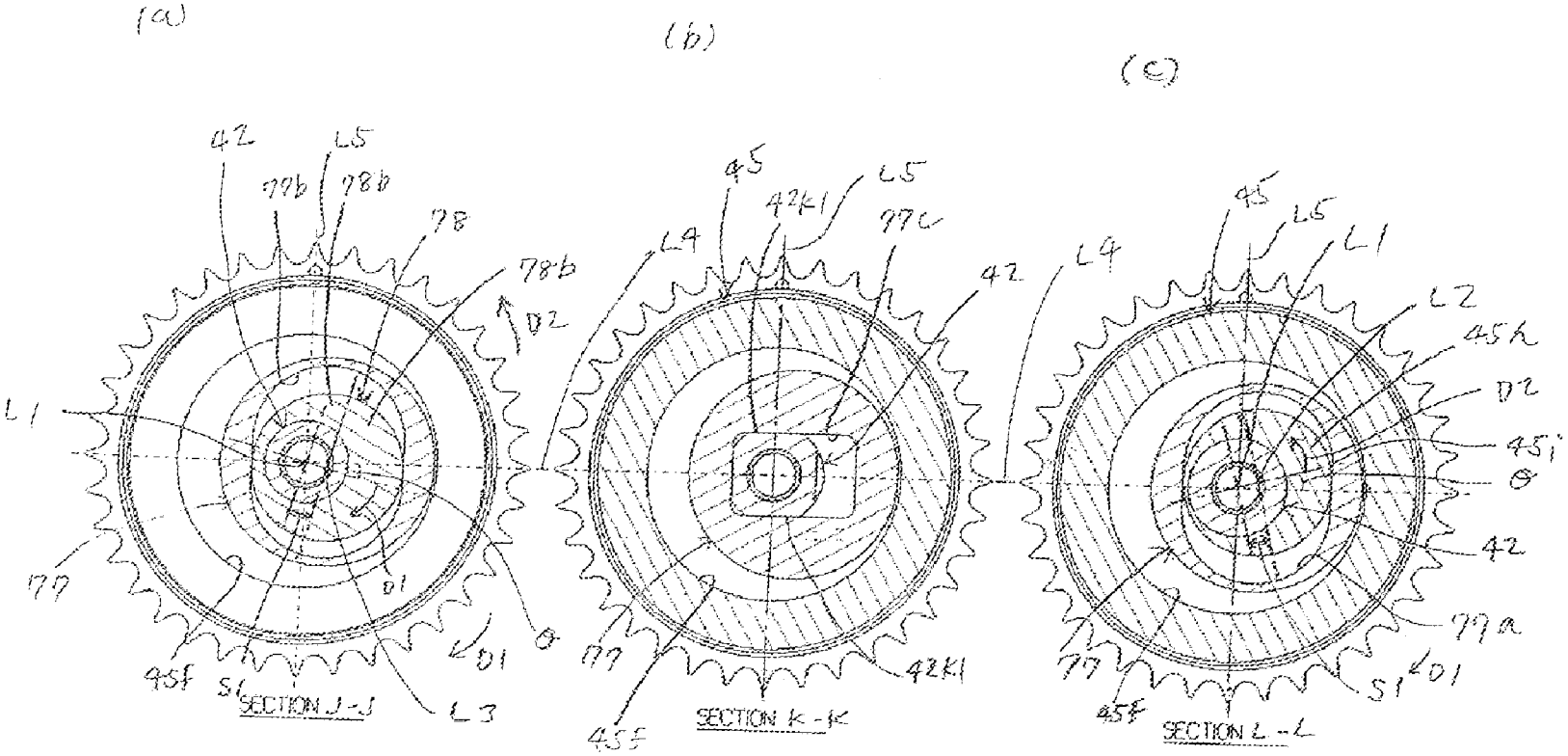
FIG. 23(*a*) shows a transverse cross section of a circular eccentric cam of a second control rotor, taken along Line J-J of FIG. 22.
Figure 24:
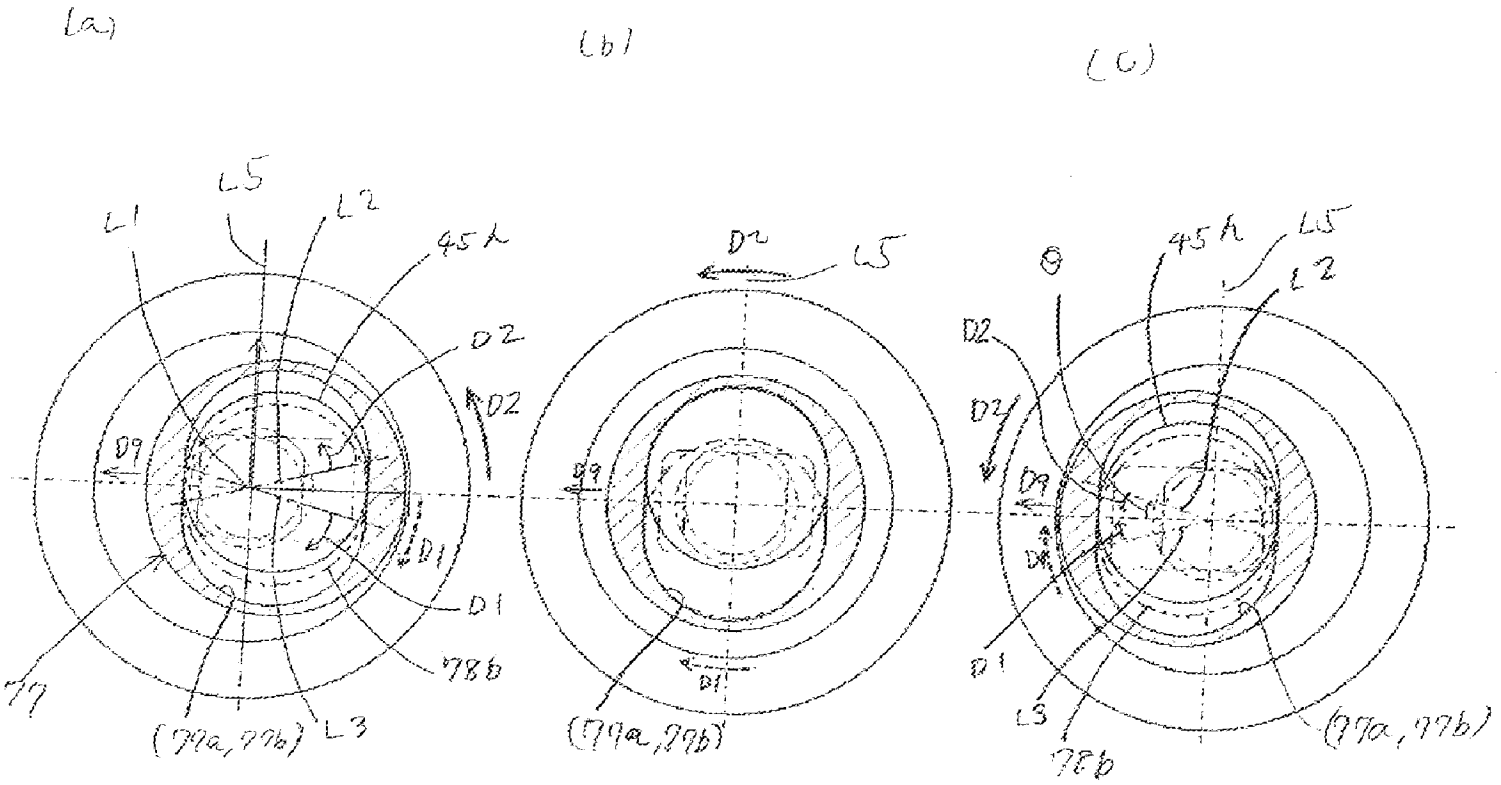
FIG. 24 is a diagram illustrating the device according to the fourth embodiment in operation.

FIG. 1 is an exploded perspective view of a phase changing device for use with an automobile engine in accordance with the first embodiment of the invention, the view taken from front; FIG. 2 is an exploded perspective view of the device according to the first embodiment taken from behind; FIG. 3 is a front view of the device according to the first embodiment; FIG. 4 is an axial cross section of the device according to the first embodiment taken along Line A-A of FIG. 3; FIG. 5(*a*) is a perspective view and FIG. 5(*b*) is an exploded perspective view of the phase varying members; FIG. 6 is a diagram showing the initial arrangement of the guide grooves and the phase varying members of the respective rotors for performing a phase angle variation in an angle retardation mode in accordance with the first embodiment of the invention; FIG. 7 is a vertical cross section of a rotational control body of the device according to the first embodiment; FIG. 8 is a cross section of a middle rotor taken along Line C-C of FIG. 4; FIG. 9 is a vertical cross section of a rotational driving body of the device according to the first embodiment taken along Line D-D of FIG. 4; FIG. 10 is a cross section of a phase varying stopper of the device according to the first embodiment taken along Line E-E of FIG. 4; FIG. 11(*a*)-(*c*) show a self-lock mechanism of the first embodiment; FIG. 12(*a*)-(*c*) show an arrangement of the phase changing device according to the first embodiment for an angularly advancing direction; FIG. 13 is an exploded perspective view of the phase changing device in accordance with the second embodiment of the invention for use with an automobile engine; FIG. 14 is an axial cross section of the device in accordance with the second embodiment of the invention; FIG. 15 is a cross section of a relative-rotation-mechanism according to the second embodiment for the rotational control body and the second rotational control body; FIG. 16 is an exploded perspective view of the phase changing device for use with an automobile engine in accordance with a third embodiment of the invention; FIG. 17 is an axial cross section of the device in accordance with the third embodiment of the invention; FIG. 18(*a*) is a transverse cross section of the second rotational control body taken along Line G-G of FIG. 17; FIG. 18(*b*) is a transverse cross section of the second rotational control body taken along Line H-H of FIG. 17; FIG. 18(*c*) is a transverse cross section of the second rotational control body taken along Line I-I of FIG. 17; FIG. 19 is a diagram showing the device in operation. FIG. 19(*a*)-(*c*) respectively show the initial condition prior to a phase variation, the condition during a phase variation, and the condition after a maximum phase variation; FIG. 20 is an exploded perspective view of the phase changing device for use with an automobile engine in accordance with the fourth embodiment of the invention; FIG. 21 is an exploded perspective view of the device according to the fourth embodiment as viewed from behind; FIG. 22 is an axial cross section of the device in accordance with the fourth embodiment of the invention; FIG. 23(*a*) shows a transverse cross section of a circular eccentric cam of a second rotational control body, taken along Line J-J of FIG. 22;

FIG. 23(*b*) shows a cross section of a cam guide plate taken along Line L-L of FIG. 22; and FIG. 23(*c*) shows a cross section of the circular eccentric cam of the rotational control body, taken along Line L-L of FIG. 22; and FIG. 24 is a diagram illustrating the fourth device in operation. FIG. 24(*a*)-(*c*) respectively show the initial condition of the device prior to phase variation, during a phase variation, and after a maximum phase variation.

The phase changing devices shown in these figures are in accord with either one of the first through the fourth embodiments of the invention. The device is integrally assembled to an engine such that the rotation of the crankshaft is transmitted to the camshaft to synchronize the opening-closing of the air suction/exhaustion valves with the rotational motion of the crankshaft of the engine, and to adjust the opening-closing timing in accordance with the load and/or rpm of the engine.

As shown in FIGS. 1 through 4, an device of embodiment 1 comprises a drive rotor 41 integrally formed of a sprocket member 46 driven by the crankshaft (not shown) and a drive plate 47. The drive rotor 41 is rotatably mounted on a center shaft 42 which is integrated to the camshaft 40 of the device. A middle rotor 43 is immovably fixed, ahead of the drive rotor 41, to the center shaft 42. A control rotor 45 is rotatably mounted on the front end of the center shaft 42 and adapted to be controlled by an electromagnetic clutch 44. The drive rotor 41, the middle rotor 43, and the control rotor 45 are arranged coaxially about the axis L1.

The leading end 40*a* of the camshaft 40 is securely fixed in the circular hole 42*a* of the center shaft 42. Cylindrical sections 42*c* and 42*d*, formed before and after a pair of flange-shaped stopper protrusions 42*b* provided on the outer surface of the center shaft 42, are rotatably fitted in the circular holes 46*c* and 47*a* of the sprocket member 46 and of the drive plate 47, respectively, to rotatably support the sprocket member 46 and drive plate 47. The sprocket member 46 has sprockets 46*a* and 46*b*. The sprocket member 46 and the drive plate 47 are integrally coupled with a multiplicity of coupling pins 48 to form the drive rotor 41.

The drive plate 47 is provided with a pair of curved second guide grooves 52. A central circular hole 47*a* is formed in the drive plate 47. In the first embodiment, the second guide grooves 52 are elongate grooves extending in the counterclockwise direction (as viewed from the front) and curving radially inward so that the radius of the grooves from the rotational axis L1 decreases continuously.

A square axial through hole 43, a pair of oblique guide grooves 49 skewed in the direction from an upper right side to a lower left side of the radius crossing the grooves as viewed from before backward, and escape holes 50 each running in parallel to the respective oblique guide grooves are formed in the disk shaped middle rotor 43. The middle rotor 43 is securely fixed to the center shaft 42 by fitting the flat engaging face 42*j* of the center shaft 42 in the square hole 43*a* of the middle rotor 43.

The control rotor 45 has a central circular hole 45*a* and a pair of curved first guide grooves 51. In the first embodiment, the first guide grooves 51 are elongate grooves extending in the clockwise direction (as viewed from front) and curving radially inward, so that the radii of the grooves from the central axis L1 decrease continuously. The drive rotor 45 is rotatably mounted on the cylindrical section 42*e* provided on the leading end of the center shaft 42 via a thrust bearing 53 mounted in a recessed circular bore 45*d* formed in the front end of the circular hole 45*a*.

An electromagnetic clutch 44 for attracting the control rotor 45 when a coil 44*a* is energized is mounted on an engine casing (not shown) at a position ahead of the control rotor 45. Inside the electromagnetic clutch 44 is a spring holder 55 having a torsion spring 54 arranged on the outer circumference thereof. The leading end 55*a* of the torsion spring 54 is hooked in a recess 42*f* formed in the center shaft 42. The spring holder 55, the center shaft 42, and the camshaft 40 are coupled integrally by passing a bolt 56 through the central holes 55*b* and 42*g* of the spring holder 55 and the center shaft 42, respectively, and tightly screwing the bolt 56 into a threaded female bore 40*b* formed in the camshaft 40. Thus, the spring holder 55 and the center shaft 42 rotates together with the camshaft. The opposite ends 54*a* and 54*b* of the torsion spring 54 are securely fixed in the bore 45*b* formed in the control rotor 45 and in the bore 55*c* of the spring holder 55 to urge the control rotor 45 in the direction opposite to the rotational direction of the drive rotor 41 against the control torque provided by the electromagnetic clutch 44.

Each of the phase varying members 57 has a block section 58, a first slide member 59, and a second slide member 60 as shown in FIG. 5. The block sections 58, the first slide members 59, and the second slide members 60 of the phase variation members 57 respectively engage the first guide grooves 51, the oblique guide grooves 49, and the second guide grooves 52, as shown in FIG. 6 (escape hole 50 not shown). Each of the block sections 58 is a generally oblong member having a convex surface 58*a* of the same curvature as the radially outward circumference 51*a* of the first guide groove 51 and a second concave surface 58*b* of the same curvature as the radially inward circumference 51*b* of the first guide groove 51, so that the block section 58 can freely move in the first guide groove 51.

Each of the first slide members 59 has a coupling shaft 59*a* fitted in a circular bore 58*c* of the block section 58 and a slide shaft 59*b* engaging the oblique guide groove 49 for movement therein. Each of the second slide members 60 has a coupling shaft 60*a* fitted in a circular bore 58*d* of the block section 58 and a slide shaft 60*b* movable in the second guide groove 52. The coupling shaft 60*a* has a smaller outer diameter than the width of the escape hole 50 and passes through the escape hole 50 without touching it.

It is preferred to securely fix the coupling shafts 59*a* and 60*a* in the respective circular bores 58*c* and 58*d*, or rotatably mount the slide shafts 59*b* and 60*b* on the coupling shafts 59*a* and 60*a* that are securely fitted in the respective circular bores 58*c* and 58*d*, thereby making the slide shafts 59*b* and 60*b* slidable in the oblique guide grooves and the second guide grooves 52. In this configuration, these shafts can move smoothly in the guide grooves 49 and 52, thereby reducing wear of the slide shafts 59*b* and 60*b*. Preferably, the slide shaft 59*b* and 60*b* are rollable in the guide grooves 49 and 52. Alternatively, however, they can be fixed in the circular holes 58*c* and 58*d* together with the coupling shafts 59*a* and 60*a* but slidable in the guide grooves 49 and 52.

FIGS. 6 through 10 shows the device of the first embodiment in a phase varying operation. In the first embodiment, the device can operate in a phase angle retardation mode in which the middle rotor 43 is rotated in the counterclockwise direction D2 from the initial delay-free position to delay the phase angle of the middle rotor 43 coupled to the camshaft 40 relative to the drive rotor 41 in rotation in the clockwise direction D1 as viewed from the front. The phase varying members 57 engaging the first guide grooves 51, the oblique guide grooves 49, and the second guide grooves 52 are initially located at the most radially outward positions possible, as shown in FIG. 6. Under the initial condition, the control rotor 45 is urged in the clockwise direction by the torque supplied by the torsion spring 54, and the middle rotor 43 and the control rotor 45 rotate in the direction D1 together with the drive rotor 41 since the phase varying members 57 are immovably fixed.

As the electromagnetic clutch 44 is energized, the control rotor 45 shown in FIG. 7 is attracted to the electromagnetic clutch 44 and abuts on frictional members 61 (FIG. 4), when the control rotor 45 begins to rotate in the counterclockwise direction D2 relative to the drive rotor 41 and the middle rotor 43. In this case, the block sections 58 of FIG. 6 tend to rotate in the clockwise direction D1 in the first guide grooves 51, which causes the phase varying members 57 to shift as a whole in the radially inward direction D3, thereby decreasing the distance between the rotational axis L1 and the first guide grooves 51.

As shown in FIG. 8, each of the oblique guide grooves 49 is skewed through an angle of δ with reference to Line L2 connecting the rotational axis L1 and the respective axes of the first slide shafts 59*b* in the angularly advancing direction (that is, in the clockwise direction D1) relative to the drive rotor 41. The first slide shafts 59*b*, engaged with the oblique guide grooves 49, are displaced in the oblique guide grooves 49 in the radially inward direction D3.

When displaced in the radially inward direction D3, the second slide shafts 60*b* shown in FIG. 9 are also displaced in the counterclockwise direction D2 in the second guide grooves 52. Then, the middle rotor 43 is angularly delayed (or rotated) relative to the drive rotor 41 in accordance with the displacements of the second slide shafts 60*b* in the second guide grooves 52. Consequently, the phase angle of the camshaft 40 together with the middle rotor 43 relative to the drive rotor 41 driven by the crankshaft is changed in the angularly delaying direction (that is, counterclockwise direction D2).

It is noted that the angular delay of the middle rotor 43 relative to the drive rotor 41 increases until the torque of the coil spring 54 balances the torque of the electromagnetic clutch 44. The maximum angular delay corresponds to the displacement of the second slide shaft 60*b* from one end of the second guide groove 52 to the other end.

On the other hand, if the electric current through the electromagnetic clutch 44 is reduced to weaken the braking power of the control rotor 45, the control rotor 45 shown in FIG. 7 rotates backward by the torque of the spring 54 in the clockwise direction D1 relative to the middle rotor 43, which in turn causes the phase varying member 57 to move radially outward (in the direction opposite to D3).

In this case, the guide grooves 49 are subject to force from the first slide shafts 59*b* sliding in the oblique guide grooves 49, and the second guide grooves 52 are subject to force from the second slide shafts 60*b* moving in the second guide grooves 52 in the clockwise direction D1. Accordingly, the middle rotor 43 is rotated in the angularly advancing direction (or clockwise direction D1) relative to the drive rotor 41 rotated by the crankshaft, thereby restoring the initial maximum phase angle between the camshaft 40 and the drive rotor 41.

FIG. 10 shows a pair of stopper protrusions 42*b* formed on the center shaft 42 engaged with the stopper recess 47*a* formed in the drive plate 47. When the block sections 58, the first slide shafts 59*b*, and the second slide shafts 60*b* assume their initial positions prior to any phase variation, or the positions at the maximum phase variation, tips 42*b*1 and 42*b*2 of the stopper protrusions 42*b* touch end portions 47*a*1 and 47*a*2 of the respective stopper recesses 47*a* to serve as stoppers. Thus, they prevent the block sections 58, the first slide shafts 59*b*, and the second slide shafts 60*b* from directly colliding the respective first guide grooves 51, the oblique guide grooves 49, and the second guide grooves 52, thereby relieving their collision impact.

FIG. 11 shows a self-lock mechanism to prevent the phase angle of the middle rotor 43 relative to the drive rotor from being changed if the middle rotor 43 is subjected to an abrupt disturbing torque from the camshaft 40. In the event that the middle rotor 43 in rotation together with the drive rotor 41 and control rotor 45 in the clockwise direction D1 is subjected to a disturbing torque from a valve spring in the counterclockwise direction D2 via the camshaft 40, as shown in FIG. 11(*a*), the oblique guide grooves 49 of the middle rotor 43 tend to rotate in the direction D2 relative to the drive rotor 41 and the control rotor 45.

Since the oblique guide grooves 49 are skewed by angle δ in the clockwise direction with respect to Line L2 connecting the rotational axis L1 and the respective axis of the first slide shafts 59*b*, if the first slide shafts 59*b* are subjected to such disturbing torque from the oblique guide grooves 49 in the direction D2, the torque exerts force on the first slide shafts 59*b* in the radially outward directions F1.

On the other hand, the second slide shafts 60*b* are subject to force in the counterclockwise direction D2 via the first slide shafts 59*b* and the block sections 58 coupled thereto. However, since the first slide shafts 59*b* engage the second guide grooves 52 which are curved radially inward, the second slide shafts 60*b* moves in the radially inward direction in the second guide grooves 52, rather than along the circumference of the drive rotor 41.

Consequently, the block section 58 is directed in the counterclockwise direction D4 by the radially outward components of the forces F1 acting on the first slide shafts 59*b* and by the radially inward components of the forces F2 acting on the second slide shafts 60*b*, as shown in FIG. 11(*c*). Thus, the convex surfaces 58*a* of the block sections 58 are forced against the radially outward circumferences 51*a* of the first guide grooves 51 near the corresponding first slide shafts 59*b*. Further, the concave surfaces 58*b* are pushed against the radially inward circumferences 51*b* of the first slide grooves 51 near the second slide shafts 60*b*. The friction takes place on both of the radially inward and outward circumferences of the first guide grooves 51, resulting in the block sections 58 immovably locked in the respective first guide grooves 51.

On the other hand, in the event that the middle rotor 43 is urged in the angularly advancing direction D1 relative to the drive rotor 41 and the control rotor 45 by disturbing clockwise torque transferred from the camshaft 40, the first slide shafts 59*b* are subject to radially inward force and the second slide shafts 60*b* are subject to radially outward force. Consequently, the block sections 58 are deflected in the clockwise direction D4, thereby generating friction on both the radially inward and outward sides of the circumference of the first guide grooves 51, which cause the middle rotor 43 to be immovably locked in the first guide groove 51.

As described above, if disturbing torque happens to the middle rotor 43 from the camshaft 40 shown in FIG. 1, the phase varying members 57 are immovably locked and so is the middle rotor 43 relative to the drive rotor 41, thereby keeping the phase angle between them unchanged. It should be noted that in this case the locking frictional forces are distributed over the radially inward and outward circumferences 51*a* and 51*b* of the first guide grooves 51, frictional wear of the guide grooves 51 and phase varying members 57 is reduced.

FIGS. 12(*a*)-(*c*) show the arrangements of the guide grooves 51, 49', and 52' of the respective rotors and of the phase varying members 57 for a case where the middle rotor 43 has initially no angular displacement relative to the drive rotor 41, but is advanced in the angularly advancing direction as needed.

As shown in FIG. 12(*a*), the oblique guide grooves 49' of this phase changing device are skewed through an angle of δ towards the angularly delaying direction (that is, in the opposite counterclockwise direction D2 in contrast to the first embodiment) with reference to the Lines L2 connecting the rotational axis L1 and the respective axes of the first slide shafts 59*b*. The configuration of this phase changing device is the same as that of the above-described device for performing phase angle variation in an angle retardation mode, except that in the present embodiment, the second guide grooves 52' extend in the clockwise direction D1 (opposite to the direction of the first embodiment).

When a brake is applied to the control rotor 45, the block sections 58 are displaced in the first guide grooves 51 to move the phase varying members 57 in the radially inward direction D5 as shown in FIG. 12(*a*). In this case, the first slide shafts 59*b* are displaced in the respective oblique guide grooves 49', and the second slide shafts 60*b* are displaced in the clockwise direction D1 and in the radially inward direction D5. Consequently, the first slide shafts 59*b* and second slide shafts 60*b* are subject to force from the respective oblique guide grooves 49 and the second guide grooves 52', which causes the middle rotor 43 having the oblique groove 49' to rotate in the angularly advancing clockwise direction D1 relative to the drive rotor 41, hence advancing the phase angle of the camshaft 40 relative to the drive rotor 41. If the braking on the control rotor 45 is reduced, the phase angle of the camshaft 40 is retarded relative to the drive rotor 41 by the backward torque of the torsion spring 54.

In the event that the oblique guide grooves 49' of the middle rotor 43 are urged to move in the counterclockwise direction D2 relative to the drive rotor and the control rotor 45 by a disturbing torque transferred from the camshaft 40, the first slide shafts 59*b* are subject to force F3 in the radially outward directions, since each of the oblique guide grooves 49' is skewed by the angle δ with respect to Line L2 that connects the axis L1 and the axis of the first slide shaft 59*b*. On the other hand, in response to the forces F3, the second slide shafts 60*b* are pulled radially inward (that is, along the curved second guide groove 52) by the block sections 58 coupled thereto (by forces F4 say as shown in FIG. 12) rather than being pulled in the circumferential direction of the drive rotor 41.

Consequently, the motions of the block sections 58 are deflected in the counterclockwise direction D6 by the radially outward component of the forces F3 acting on the first slide shafts 59*b* and the radially inward component of the forces F4 acting on the second slide shafts 60*b*, as shown in FIG. 12(*c*). On the other hand, in the event that the middle rotor 43 is subject to torque that urges the camshaft 40 to rotate in the angularly advancing direction D1 relative to the drive rotor and the control rotor 45, the motions of the block sections 58 are directed not in the counterclockwise direction D6 but in the clockwise direction. The block sections 58 generate frictional forces between themselves and the radially inward and outward circumferences (51*a* and 51*b*) of the first guide grooves 51, which causes the phase varying members 57 to be immovably locked, thereby immovably locking the middle rotor 43 relative to the drive rotor.

Further, FIGS. 13 through 15 show a phase changing device for use with an automobile engine in accordance with the second embodiment of the invention. In the second embodiment, a second electromagnetic clutch mechanism 62 is employed to restore the phase angle in place of the coil spring 54 used in the phase angle restoration mechanism in the first embodiment. This mechanism makes it possible to provide phase variation in the opposite direction comparing with the first electromagnetic clutch 44.

The second electromagnetic clutch mechanism 62 of the second embodiment includes: a second control rotor 63 arranged ahead of the control rotor 45, a multiplicity of planet gears 64 engaged with a gear 63*a* that protrudes backward from the second control rotor 63 and with a gear 45*c* in the circular hole formed in the front end of the control rotor 45, a thrust bearing 65, a spring holder 66, and a second electromagnetic clutch 67. The control rotor 45 is rotatably supported on the cylindrical section 42*l* of the center shaft 42 by rotatably fitting the cylindrical section 42*l* in the circular hole 45*a* of the control rotor 45. The second control rotor 63 is rotatably mounted on the leading end of the center shaft 42 by securely fixing the small cylindrical section 42*h* of the center shaft 42 in the circular hole 65*a* of the thrust bearing 65 fitted in the recessed circular hole 63*b* of the second control rotor 63.

The control rotor 45 and the second control rotor 63 are spaced apart in the axial direction. The spring holder 66 is fitted on the step section 42*i* formed at the leading end of the center shaft 42. A bolt 56 is tightly screwed in the threaded bore 40*b* of the camshaft 40 to prevent the constituent elements 16 of the second control rotor 63 and the like from coming off. The electromagnetic clutch 67 is secured on the engine casing (not shown) facing the second control rotor 63. The second embodiment is the same as the first embodiment in other respects.

Under the initial condition where there is no phase variation, the second control rotor 63 rotates in the clockwise direction D1 together with the control rotor 45 and the drive rotor 41. If the electromagnetic clutch 44 is energized to vary the phase angle of the middle rotor 43 relative to the drive rotor, braking action of the electromagnetic clutch 44 takes place, so that the control rotor 45 rotates in the counterclockwise direction D2 relative to the middle rotor 43 which is in rotation in the clockwise direction D1, and the phase varying members 57 are moved radially inward. Thus, the phase angle of the middle rotor 43 is changed in the angularly delaying direction (counterclockwise direction D2) relative to the drive rotor 41, in the similar way as described in the first embodiment.

On the other hand, if the second electromagnetic clutch 67 is energized, the second control rotor 63 rotates in the counterclockwise direction D2 relative to the control rotor 45 rotating in the clockwise direction D1. In this case, the control rotor 45 rotates in the clockwise direction D1 relative to the middle rotor 43 due to the counterclockwise rotation (in the direction D7) of the planet gears 64 between the gears 64*a* and 45*c*. The phase varying member 57 is moved radially outward, causing the phase angle of the middle rotor 43 to be advanced (in the clockwise direction D1) relative to the drive rotor 41, in the similar way as described in the first embodiment.

FIGS. 16 through 19 show a phase changing device according to the third embodiment of the invention. The third embodiment is a modification of the second embodiment, in which two electromagnetic clutches are used as in the second embodiment, one for the phase varying mechanism and the other for the phase angle varying mechanism. In addition, the planet gears of the phase angle restoration mechanism used in the second embodiment are replaced with slide pins.

The third embodiment includes a second middle rotor 68, a second control rotor 69, a thrust bearing 70, a spring holder 71, an electromagnetic clutch 44, and a second electromagnetic clutch 72, all arrange ahead of the control rotor 45 in the order mentioned.

As shown in FIG. 18(*a*)-(*c*), the control rotor 45 has a central circular hole 45*a* and a pair of third curved guide grooves 73 formed in the front end thereof, each extending in the clockwise direction D1 about the rotational axis L1 and having a continuously decreasing radius. The second middle rotor 68 has a central square hole 62*a* and a pair of radial guide grooves 74 formed on the opposite sides of the second middle rotor 68. The second control rotor 69 has a central circular hole 69*a*, a recessed central circular bore 69*b* formed in the front end thereof, and a pair of fourth curved guide grooves 75 formed in the rear end thereof, each extending in the counter clockwise direction D2 about the rotational axis L1 and having a continuously decreasing radius.

The control rotor 45 is rotatably supported on the cylindrical portion 42*l* of the center shaft 42 by fitting in the circular hole 45*a* thereof the cylindrical portion 42*l* of the center shaft 42. The second middle rotor 68 is immovably secured on the center shaft 42 by fitting in the square hole 68*a* thereof the second flat engaging face 42*k* of the center shaft 42. The second control rotor 69 has a recessed circular bore 69*b* that accommodates therein an embedded thrust bearing 70. The second control rotor 69 is rotatably supported on the center shaft 42 by securely fitting the small cylindrical section 42*h* of the center shaft 42 in the circular hole 70*a* of the thrust bearing 70. A pair of slide pins 76 slidably engages the guide grooves 73-75.

The control rotor 45, the second middle rotor 68, and the second control rotor 69 are spaced apart in the axial direction. A spring holder 71 is fitted on the step section 42*i* formed on the leading end of the center shaft 42. A bolt 56 is tightened in the threaded bore 40*b* formed in the camshaft 40 to prevent the constituent elements of the second control rotor 69 and the like from coming off the shaft. The second electromagnetic clutch 72 is securely fixed on the engine casing (not shown) facing the front end of the second control rotor 69. The third embodiment is the same as the second embodiment in other respect.

Under the initial condition where there is no phase variation (FIG. 19(*a*)), the second middle rotor 68 and the second control rotor 69 rotate in the clockwise direction D1 (FIG. 16) together with the control rotor 45. As in the second embodiment, the middle rotor 43 is delayed by a phase angle (the phase varied in the angularly delaying direction D2) relative to the drive rotor due to the braking action of the electromagnetic clutch 44 retarding the control rotor 45 in the counterclockwise direction D2 relative to the middle rotor 43.

In this case, the third guide grooves 73 of the control rotor 45 rotate in the counterclockwise direction D2 relative to the second middle rotor 68 and the second control rotor 69, as shown in FIGS. 18 and 19, so that the slide pins 76 are moved in the radially inward direction D8 in the guide grooves 73 and 74. The fourth guide grooves 75 are forced to move by the slide pins 76 moving radially inward. Consequently, the second control rotor 69 rotates in the clockwise direction D1 relative to the second middle rotor 68.

On the other hand, as the second electromagnetic clutch 72 is energized, the second control rotor 69 (or fourth guide grooves 75) rotates from the position shown in FIG. 19(*c*) in the counterclockwise direction D2 relative to the control rotor 45 and the second middle rotor 68 rotating in the clockwise direction D1. Consequently, the slide pins 76 move radially inward (opposite to D8) in the guide grooves 74 and 75. The slide pins 76 moving radially outward push the third guide grooves 73 such that the control rotor 45 rotate in the clockwise direction D1 relative to the second middle rotor 68. At the same time, the phase varying members 57 move radially inward since the control rotor 45 rotates in the clockwise direction D1 relative to the drive rotor. Consequently, the phase angle of the middle rotor 43 is varied in the angularly advancing direction D1 relative to the drive rotor 41, in the similar way as the second embodiment.

FIGS. 20 through 24 show a phase changing device for use with an automobile engine in according to the fourth embodiment of the invention. As in the second and third embodiments, the third embodiment has two electromagnetic clutches in the phase angle varying mechanism and phase angle restoration mechanism. In addition, the third embodiment utilizes a circular eccentric cam mechanism in the phase angle restoration mechanism.

In the fourth embodiment, there are a cam guide plate 77, a second control rotor 78, a thrust bearing 79, a spring folder 80, and electromagnetic clutches 44 and 81, all arranged ahead of the control rotor 45 in the order mentioned.

The control rotor 45 has a recessed circular bore 45*f* formed in the front end thereof, and a circular eccentric cam 45*h* formed around the circular hole 45*a*. The circular eccentric cam 45*h* extend forward from the bottom 45*g* of the recessed circular bore 45*f*, and has a central axis L2 offset from the rotational axis L1 by a distance S1.

The second control rotor 78 has a central circular hole 78*c* and a circular eccentric cam 78*b* formed around the circular hole 78*c* which protrudes backward from the rear end 78*a* of the second control rotor 78 and has a central axis L3 offset from the axis L1 by the distance S1.

On the other hand, the cam guide plate 77 is provided on the opposite end of the second control rotor 78 from the circular hole 78*c* with recessed oblong bores 77*a* and 77*b* in which the circular eccentric cams 45*h* and 78*b* are slidably fitted. The cam guide plate 77 is also provided with a generally square through hole 77*c* that extends in the direction perpendicular to the longest diameter of the oblong bores 77*a* and 77*b*.

The center shaft 42 passes through the circular through hole 45*a* of the control rotor 45 such that the control rotor 45 is rotatably supported on the cylindrical section 42*l* of the center shaft 42. The inner circumference of the square hole 77*c* of the cam guide plate 77 is mounted on the second flat engagement surface 42*k* of the center shaft 42 such that the cam guide plate 77 is not rotatable relative to the center shaft 42 but is slidable on the horizontal surface 42*k*1 of the second flat engagement surface 42*k* in the direction parallel to the long sides of the square through hole 77*c*. The second control rotor 78 is rotatably supported on the center shaft 42. This can be done by fitting the small cylindrical section 42*h* of the center shaft 42 into the inner circumference of the circular hole 79*a* of the thrust bearing 79 embedded in the recessed circular bore 78*d*.

The circular eccentric cams 45*h* and 78*b* engage the respective recessed oblong bores 77*a* ad 77*b*. Thus, when the control rotors 45 and 78 rotate relative to the cam guide plate 77, the circular eccentric cams 45*h* and 78*b* slidably reciprocate in the respective recessed oblong bores 77*a* and 77*b*.

The control rotor 45, the cam guide plate 77, and the second control rotor 78 are spaced apart in the axial direction. The spring holder 80 is fitted in the recess 42*i* formed in the front end of the center shaft 42. A bolt 56 is tightly screwed in a threaded bore 40*b* of the camshaft 40 to prevent the elements of the second control rotor 78 and the like from coming off the camshaft 42. The second electromagnetic clutch 81 is securely fixed on the engine casing (not shown) facing the front end of the second control rotor 69. The fourth embodiment is the same as the foregoing embodiments in other respects.

Under the initial condition where there is no phase variation, the cam guide plate 77 is located at the far right end inside the recessed circular bore 45*f*, the circular eccentric cam 78*b* is positioned with its central axis L3 inclined at an angle of θ in the clockwise direction D1 with reference to the horizontal axis L4 as shown in FIG. 23(*a*), and the circular eccentric cam 45*h* is positioned with its central axis L2 inclined at an angle of θ in the counterclockwise direction D2 with reference to the horizontal axis L4, as shown in FIG. 23(*c*).

Under the initial condition where there is no phase variation, the cam guide plate 77 and second control rotor 78 rotate in the clockwise direction D1 together with the control rotor 45. Under the braking action of the electromagnetic clutch 44 on the control rotor 45, the control rotor 45 rotates relative to the middle rotor 43 in a similar way as described in the second and third embodiments, thereby varying the phase angle of the middle rotor 43 in the angularly delaying direction (that is, in the counterclockwise direction D2).

Under such a condition, the circular eccentric cam 45*h* integrated to the control rotor 45 rotates from the position shown in FIGS. 23(*c*) and 24(*a*) about the rotational axis L1 in the counterclockwise direction D2 with reference to the horizontal axis L4, possibly through the maximum permissible angle of 180°-θ. At the same time, the circular eccentric cam 45*h* slidably moves upward inside the oblong bore 77*a* until the central axis L2 moves past the vertical axis L5, and then moves downward, so that the cam guide plate 77 is displaced to the left until it reaches, in the case of maximum displacement, the left end of the inner circumference of the recessed bore 45*f*.

In this case, the circular eccentric cam 78*b* is subjected to the external force applied thereto by the oblong bore 77*b* of the cam guide plate 77 and rotates in the clockwise direction D1 about the rotational axis L1 from the position shown in FIGS. 23(*a*) and 24(*a*) and reciprocates up and down inside the oblong bore 77*b*. Consequently, the second control rotor 78, which is integral with the circular eccentric cam 78*b*, rotates in the clockwise direction D1 relative to the control rotor 45 until the central axis L3 of the circular eccentric cam 78*b* is possibly displaced to the maximum permissible angle of 180°-θ in the clockwise direction D1 with reference to the horizontal axis L4.

On the other hand, when the second electromagnetic clutch 81 is energized, the second control rotor 78 (circular eccentric cam 78*b*) rotates in the counterclockwise direction D2 relative to the control rotor 45 which is rotating in the clockwise direction D1, thereby slidably reciprocating up and down on the inner circumference of the oblong bore 77*b*. Consequently, the cam guide plate 77 is displaced to the right (in the direction opposite to the direction D9) until it reaches the right end of the recessed circular bore 45*f*. Because of the rotational motion of the circular eccentric bore 45*h* in the clockwise direction D1 under an external force applied thereto by the oblong bore 77*b* of the cam guide plate 77, the control rotor 45 rotates in the clockwise direction D1 relative to the second control rotor 78. Since the control rotor 45 rotates in the clockwise direction D1 relative to the drive rotor 41, the phase varying members 57 moves radially outward. As a consequence, the phase angle of the middle rotor 43 is varied in the angularly advancing direction relative to the drive rotor (rotated in the clockwise direction D1), as in the second and third embodiment.

It should be noted that in the second through fourth embodiments use of an electromagnetic clutch for varying phase angle of the middle rotor 43 eliminates the need for a coil spring used in the first embodiment. This means that energy can be saved by cutting off the electricity to the electromagnetic clutch 44 soon after a required phase alteration is achieved. Accordingly, downsizing of the electromagnetic clutch 44 is possible, since it requires less torque.

Although a torsion spring is used in combination with an electromagnetic clutch as a torque means in the first through fourth embodiments, an electric motor can be alternatively used to directly provide the control rotor with the torque, or a hydraulic pressure chamber may be used to provide the torque.

Although a thrust bearing is used between the control rotor and the spring holder in the first embodiment, and between the second control rotor and the spring holder in the second and the fourth embodiments, a disc spring may be alternatively used. When a disc spring is used, frictional torque is generated in the control rotor and the second control rotor, which advantageously provides an inertial force in the control rotor when an abrupt change occurs in the engine rpm, for example, and can eliminate unanticipated abrupt changes in phase angle between the camshaft and the drive rotor.

The invention claimed is:

1. A phase changing device for automobile engine, having: a drive rotor driven by the crankshaft of an engine, an middle rotor integral with the camshaft of the device and arranged ahead of the drive rotor, a control rotor arranged ahead of the middle rotor and rotatable about the rotational axis common to the drive rotor and the middle rotor, the device capable of altering the relative phase angle between the drive rotor and the camshaft by rotating the middle rotor relative to the drive rotor by providing the control rotor with a torque generated by a torque means, the device characterized by comprising:

curved first guide grooves formed in the control rotor, each groove skewed with respect to a circumference of a circle centered at the rotational axis;

oblique guide grooves each groove formed in the middle rotor and extending at an angle with respect to a radius crossing the groove;

second guide grooves formed in the drive rotor and skewed with respect to the circumference of a circle centered at the rotational axis of the drive rotor, block sections each extending along, and movable in, the respective first guide;

first slide members each protruding from the respective block section for engagement with, and for movement in, the respective skewed guide groove; and phase varying members each having a second slide member that extends through an escape groove formed in the middle rotor and engages the respective second guide groove so as to move in the second guide groove.

2. The inventive device according to claim 1, wherein the first and second slide members are shaft-like members rollable in the respective first and second guide grooves.

* * * * *